US008793948B2

(12) United States Patent
Beattie

(10) Patent No.: US 8,793,948 B2
(45) Date of Patent: Aug. 5, 2014

(54) BUILDING AND METHOD OF CONSTRUCTING A BUILDING

(75) Inventor: Ronald Peter Beattie, Chedgrave (GB)

(73) Assignee: Beattie Passive Build System Ltd., Norfolk (GB)

( * ) Notice: Subject to any disclaimer, the term of this patent is extended or adjusted under 35 U.S.C. 154(b) by 44 days.

(21) Appl. No.: 13/262,864

(22) PCT Filed: Apr. 7, 2010

(86) PCT No.: PCT/GB2010/000700
§ 371 (c)(1),
(2), (4) Date: Dec. 20, 2011

(87) PCT Pub. No.: WO2010/116136
PCT Pub. Date: Oct. 14, 2010

(65) Prior Publication Data

US 2012/0079776 A1 Apr. 5, 2012

(30) Foreign Application Priority Data

Apr. 9, 2009 (GB) ..... 0906278.7

(51) Int. Cl.
*E04B 7/04* (2006.01)
*E04B 5/00* (2006.01)
*E04C 3/02* (2006.01)

(52) U.S. Cl.
USPC ..... 52/267; 52/693; 52/91.3

(58) Field of Classification Search
USPC ..... 52/262–265, 267, 693–696, 92.1, 93.1
See application file for complete search history.

(56) References Cited

U.S. PATENT DOCUMENTS 1,911,018 A * 5/1933 Goeltz ..... 52/648.1
3,331,170 A * 7/1967 Lowe et al. ..... 52/79.11
3,559,355 A * 2/1971 Day, Jr. ..... 52/251
4,030,256 A * 6/1977 Ollman ..... 52/93.1

(Continued)

FOREIGN PATENT DOCUMENTS

EP 1522644 4/2005
EP 1600573 A1 11/2005

(Continued)

OTHER PUBLICATIONS

Search Report in corresponding GB Application No. 0906278.7 dated Jul. 8, 2009.

(Continued)

*Primary Examiner* — Joshua J Michener
*Assistant Examiner* — Elizabeth A Plummer
(74) *Attorney, Agent, or Firm* — Knobbe, Martens, Olson & Bear, LLP

(57) ABSTRACT

A method of constructing a building including erecting a plurality of truss elements to form a framework including one or more walls, a roof structure and a floor structure. Each truss element includes at least two joists and a plurality of braces that maintain the joists in a parallel arrangement, the truss elements being arranged in the framework to provide an inner joist and an outer joist. An inner covering layer and an outer covering layer are attached to the framework, thereby forming an enclosed void between the inner and outer covering layers that extends substantially continuously around the framework. An insulating material is injected into the void to form a substantially continuous insulating layer between the inner and outer layers.

12 Claims, 21 Drawing Sheets

(56) References Cited

U.S. PATENT DOCUMENTS

| | | | | | |
|---|---|---|---|---|---|
| 4,125,981 | A | * | 11/1978 | MacLeod et al. | 52/309.12 |
| 4,290,246 | A | * | 9/1981 | Hilsey | 52/169.1 |
| 4,516,363 | A | | 5/1985 | Beaulieu et al. | |
| 4,653,239 | A | * | 3/1987 | Randa | 52/91.3 |
| 4,656,792 | A | * | 4/1987 | Clark | 52/93.1 |
| 4,862,662 | A | * | 9/1989 | Eberle et al. | 52/299 |
| 4,894,964 | A | | 1/1990 | Thrift et al. | |
| 4,914,883 | A | * | 4/1990 | Wencley | 52/309.5 |
| 5,205,091 | A | * | 4/1993 | Brown | 52/126.6 |
| 5,287,674 | A | * | 2/1994 | Sperber | 52/742.13 |
| 5,755,067 | A | | 5/1998 | Mercurio | |
| 6,006,485 | A | * | 12/1999 | Hobbs et al. | 52/489.1 |
| 6,052,953 | A | * | 4/2000 | Jewell | 52/93.1 |
| 6,314,696 | B2 | * | 11/2001 | Fust, III | 52/422 |
| 6,584,741 | B1 | * | 7/2003 | Hatzinikolas | 52/289 |
| 6,854,230 | B2 | * | 2/2005 | Starke | 52/481.1 |
| 7,174,681 | B2 | * | 2/2007 | Wilson et al. | 52/169.14 |
| 7,185,471 | B2 | * | 3/2007 | Schmerber | 52/642 |
| 2001/0027629 | A1 | | 10/2001 | Ojala | |
| 2005/0126108 | A1 | * | 6/2005 | Wilson et al. | 52/698 |
| 2008/0016802 | A1 | * | 1/2008 | Rheaume | 52/220.1 |
| 2008/0196349 | A1 | * | 8/2008 | Gonzalez | 52/653.1 |

FOREIGN PATENT DOCUMENTS

| | | | |
|---|---|---|---|
| GB | 825399 | | 12/1959 |
| GB | 847072 | | 9/1960 |
| GB | 2425318 | A * | 10/2006 |
| GB | 2476708 | A * | 7/2011 |
| WO | WO 93/14278 | | 7/1993 |

OTHER PUBLICATIONS

International Search Report in corresponding Application No. PCT/GB2010/000700 dated Sep. 6, 2010.

* cited by examiner

*Fig. 16*
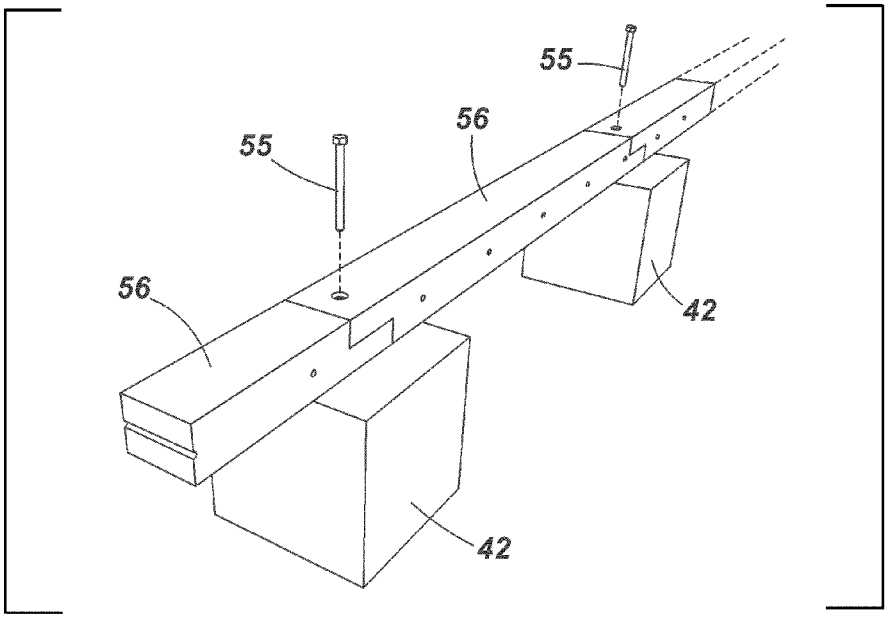
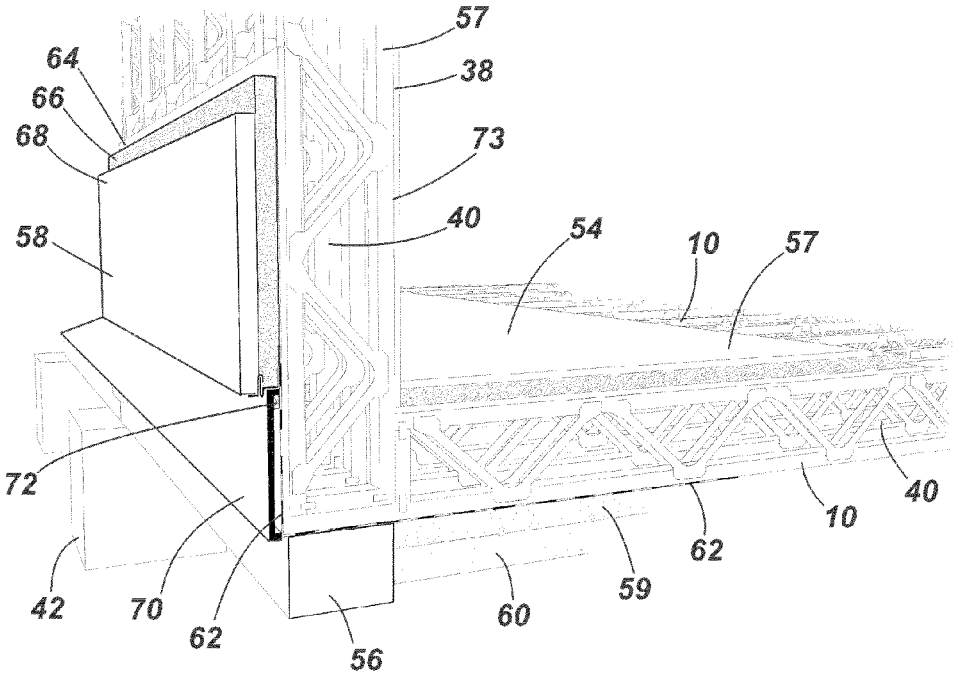
*Fig. 17*

BUILDING AND METHOD OF CONSTRUCTING A BUILDING

RELATED APPLICATIONS

This application is the U.S. National Phase filing under 35 U.S.C. §371 of PCT/GB2010/000700, filed Apr. 7, 2010, which designated the United States and was published in English, which claims priority under 35 U.S.C. §119(a)-(d) to Great Britain Patent Application No. 0906278.7, filed Apr. 9, 2009, the content of which is incorporated herein by reference in its entirety.

FIELD OF THE INVENTION

The present invention relates to a building and to a method of constructing a building. In particular, but not exclusively, the invention relates to buildings such as houses, schools, offices, hospitals and similar buildings, and a method of constructing such buildings.

BACKGROUND OF THE INVENTION

There are numerous problems associated with conventional construction methods. One problem is that with many construction methods it is very difficult to construct a building having a very high degree of thermal insulation. Often, thermal insulation is provided by inserting an insulating material into a cavity between the inner and outer leaves of a wall. This material may be incorporated during construction of the building, for example by inserting solid blocks of an insulating material into the cavity between the inner and outer walls as the walls are constructed. Alternatively, an insulating material for example in the form of expanding foam may be pumped into the cavity between the inner and outer walls, after the walls have been constructed.

Different methods may be employed for insulating the roof space: for example, a blanket of fibrous matting may be laid between the ceiling rafters within the roof space. However, these conventional insulation methods often result in gaps being left at various places around the building, for example around the eaves and beneath the floor space. These gaps allow thermal bridging and enable air to flow into and out of the building, thereby allowing heat to escape.

Another problem with many conventional construction methods is that the construction costs are very high. For example, for conventional houses with brick or stone walls deep trenches have to be dug and concrete foundations laid in order to support the weight of the walls. This is both time-consuming and expensive. Another problem with many conventional buildings is that they are constructed using methods that are very labour intensive, such as by laying bricks. This also increases the cost of construction.

A further problem is that methods relying on the construction of solid walls make inspection of the building during construction very difficult, as many of the structural components will be hidden during the building process. This makes it difficult to confirm that the building complies with building regulations and good building practices.

It is an object of the present invention to provide a building, and a method of constructing a building, that mitigates one or more of the aforesaid disadvantages.

SUMMARY OF THE INVENTION

According to the present invention there is provided a method of constructing a building comprising a plurality of walls, a roof and a floor, said method including erecting a plurality of truss elements to form a framework comprising at least two opposed wall structures, a roof structure and a floor structure, each said structure comprising a plurality of truss elements, and each truss element including at least two joists and a plurality of braces that maintain the joists in a parallel arrangement, each said truss element being arranged in said framework to provide an inner joist and an outer joist; attaching an inner covering layer and an outer covering layer to said framework, thereby forming an enclosed void between said inner and outer covering layers that extends substantially continuously through the floor structure, the roof structure and the opposed wall structures, and injecting an insulating material into said void to form an insulating layer between the inner and outer layers that extends substantially continuously through the floor structure, the roof structure and the opposed wall structures.

The method allows buildings to be constructed relatively easily and at little or no additional cost as compared to conventionally constructed buildings, but to a very high level of thermal insulation, for example to a U-value for roofs, floors and external walls of less than 0.15 $W/m^2K$ and possibly as low as 0.05 $W/m^2K$. This greatly exceeds the levels of thermal insulation that can be achieved using conventional construction methods without incurring substantial additional cost. This very high level of insulation is achieved owing to the fact that the insulation layer extends substantially continuously and seamlessly around the entire periphery of the building (including the roof structure, the walls and the floor) and seals any gaps in the structure, thus avoiding thermal bridges and preventing air leakage.

The construction method is simple to implement, requiring only basic construction skills and reducing the need for expensive plant and equipment. This leads to benefits in terms of improved safety at the construction site. The construction method is also very suitable for the rapid construction of buildings in an emergency, for example following an earthquake or other disaster, when skilled labour and expensive construction equipment may be in short supply. In such a case, the buildings may be constructed from locally available materials or from pre-fabricated kits of parts.

The structure of the building is very light and strong, owing to the direct connection between the truss elements forming the walls, the floor and the roof. The building does not therefore require very deep or continuous foundations and it is able to resist strong external forces, for example from earthquakes, hurricanes and other causes.

Furthermore, buildings constructed using a method according to the invention have an open framework that can be easily inspected during construction, allowing surveyors and building inspectors to confirm that the buildings meet all relevant building standards and regulations.

Advantageously, at least some of the truss elements that form the floor structure, the roof structure and the opposed wall structures are interconnected end-to-end to form a substantially continuous framework that extends through the floor structure, the roof structure and at least one of the wall structures.

Preferably, the interconnected truss elements that form each substantially continuous framework are located in a common vertical plane.

Preferably, the inner joists of the interconnected truss elements are interconnected, and the outer joists of the interconnected truss elements are interconnected.

Preferably, the method includes erecting a plurality of truss elements to form at least one end wall structure and attaching an inner covering layer and an outer covering layer to the end wall structure to form an end wall void, said end wall void being connected to the void that extends through the floor structure, the roof structure and the opposed wall structures.

Advantageously, the inner and outer layers forming the void have a separation in the range 50-600 mm, preferably 200-450 mm. We have found that with currently available insulating materials this separation provides an optimum balance of insulation thickness against building cost.

Preferably, the framework is supported on discrete piles or foundation pads. This reduces the cost of construction by avoiding the need to excavate conventional foundations. As the structure of the building is very light but strong, simple piles or foundation pads have been found to provide adequate support.

A damp-proof membrane may be fitted beneath the floor structure. Advantageously, the damp-proof membrane extends at least partly up the walls of the building, preferably to a height of at least 150 mm above ground level. The membrane may be extended to a greater height if required, for flood protection. This provides a very high level of flood protection (particularly if the building is also fitted with water-tight doors and windows).

The insulating layer in the roof structure may be provided within a ceiling structure, for example below a loft space. Alternatively, the insulating layer in the roof structure may be provided within a sloping roof structure, above a loft space.

Advantageously, the method includes applying an external finishing layer to the outer covering layer of at least one of the walls and/or the roof structure. Preferably, the external finishing layer includes an insulating layer.

According to another aspect of the invention there is provided a building including a plurality of walls, a roof and a floor, a plurality of truss elements that form a framework comprising at least two opposed wall structures, a roof structure and a floor structure, each said structure comprising a plurality of truss elements, and each truss element including at least two joists and a plurality of braces that maintain the joists in a parallel arrangement, each said truss element being arranged in said framework to provide an inner joist and an outer joist; an inner covering layer and an outer covering layer attached to said framework and providing an enclosed void between said inner and outer covering layers that extends substantially continuously through the floor structure, the roof structure and the opposed wall structures, and an insulating material filling said void and forming an insulating layer between the inner and outer layers, wherein the insulating layer extends substantially continuously through the floor structure, the roof structure and the opposed wall structures.

BRIEF DESCRIPTION OF THE DRAWINGS

Embodiments of the present invention will now be described, by way of example, with reference to the accompanying drawings, in which:

FIG. 16 is a perspective view showing a detail of the foundation structure;

FIG. 17 is a sectional view showing in perspective a detail of the ground floor structure.

DETAILED DESCRIPTION OF THE PREFERRED EMBODIMENT

Figure 1:
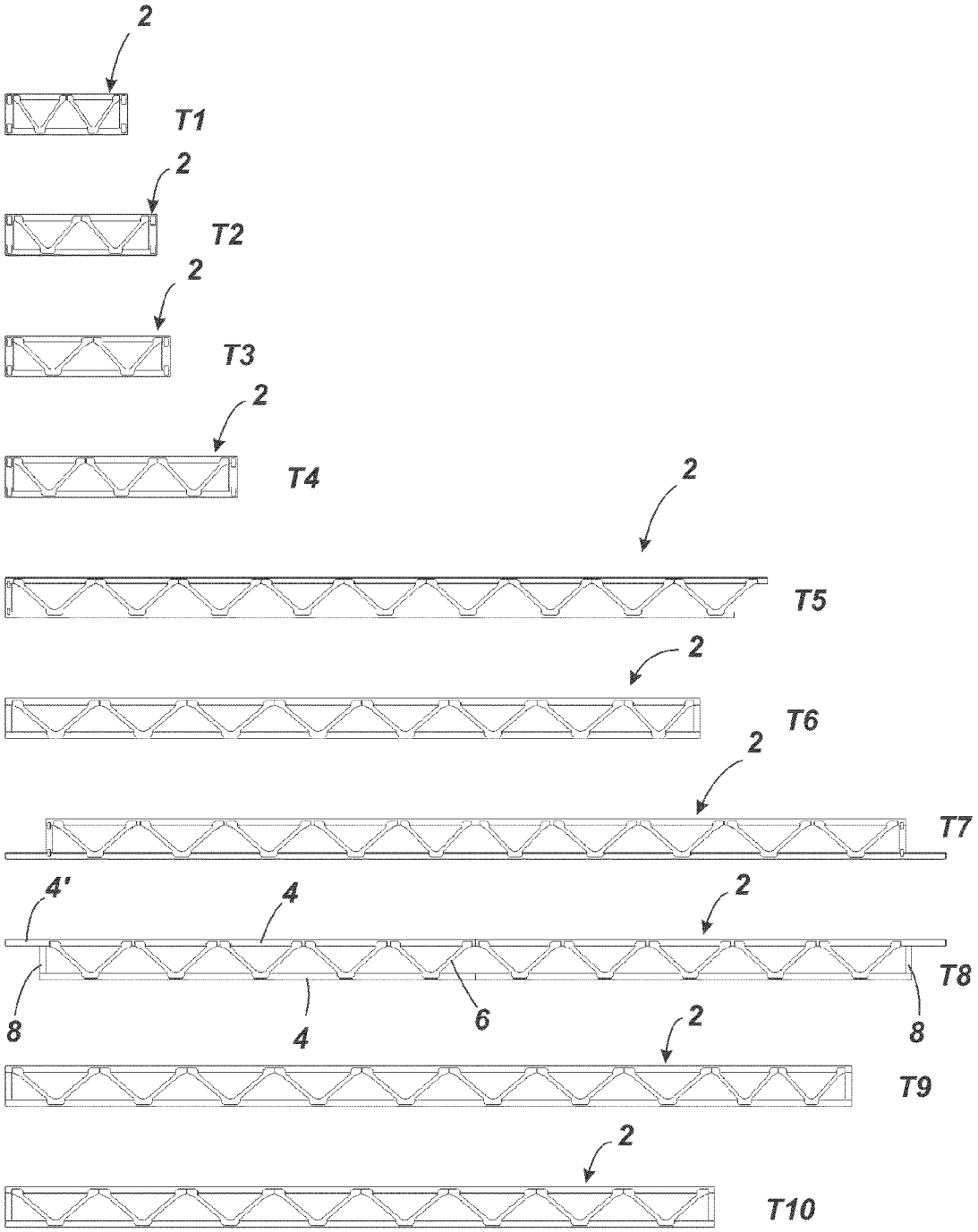
FIG. 1 depicts a set of trusses suitable for constructing a building, which in this example is a simple two-storey house.

FIG. 1 shows a set of trusses 2 used in the construction method to construct a building, in this case a simple two storey house. In this example, ten types of truss 2 are shown, which vary in length and are referred to as types T1-T10. Each truss 2 includes two parallel elongate members or joists 4, which are preferably made of timber but may alternatively be made of other materials (for example steel, concrete etc). The two joists are interconnected by a series of braces 6, which may for example be made of galvanised steel and which maintain a constant separation between the joists.

In some trusses (for example types T1-T4, T6 and T9-T10) the two joists 4 are of equal length and their ends are joined by a cross-strut 8. In other trusses (for example types T5, T7 and T8), one joist is slightly longer and includes a portion 4' at one or both ends that extends beyond the end of the other joist. In types T7 and T8, a cross-strut 8 is provided adjacent each end of the joist to support the extended portion 4'.

In the construction method, large numbers of trusses of various types are used. These trusses are preferably made to a standard specification, with a constant separation between the internal faces of the joists. For example, the individual joists may each have dimensions of 75×47 mm and be set at a separation between their internal faces of 206 mm, thus providing a width of 300 mm between the external faces of the joists. Other dimensions are of course possible, although generally it is preferred that the width between the external faces of the joists should be in the range 50-600 mm, preferably 200-450 mm. The length of each truss may vary according to the type of the truss and the intended location of the truss in the building. Typically the length may be up to about 10 meters.

In constructing a building, the types and number of trusses required to construct the framework of the building is calculated and the trusses are then fabricated and labelled. Normally, the trusses will be pre-fabricated off-site and labelled prior to delivery to the building site. Alternatively, they may be fabricated on-site. These trusses are then assembled in a predetermined order during construction of the building.

The layout of the trusses and other elements used in the construction of a simple two storey house is illustrated in FIGS. 2-17. It should be understood that these drawings illustrate only a single example of a typical building constructed according to the method disclosed herein: the number and layout of the trusses may be different in the construction of other buildings.

Figure 2:
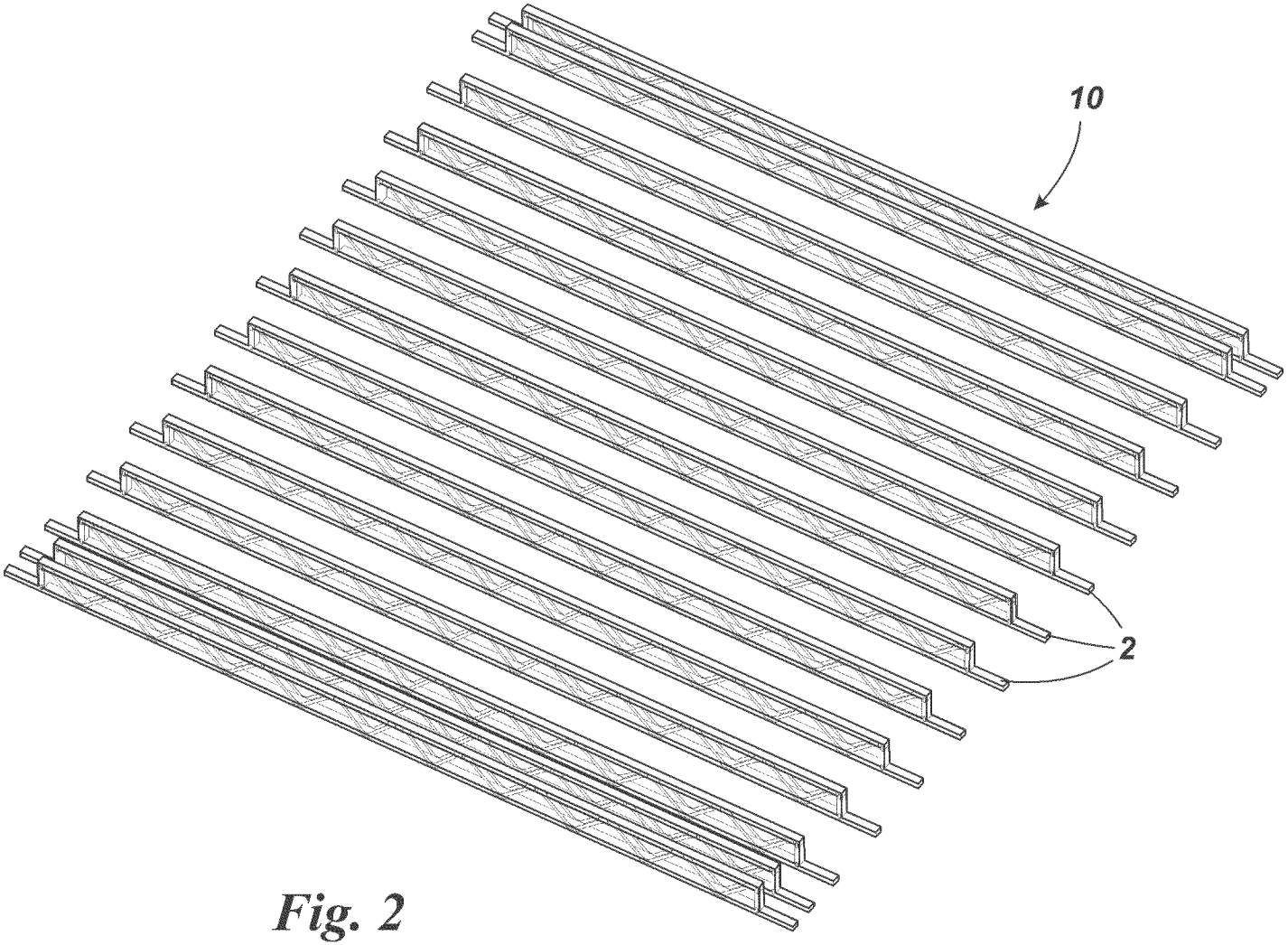
FIG. 2 is a perspective view showing the layout of the trusses forming the ground floor of the house.

In this example, the framework of the ground floor 10 is constructed from fourteen trusses 2 of type T7, each having a shorter upper joist and a longer lower joist. These trusses are arranged parallel to one another, as illustrated in FIG. 2, mostly at a centre-to-centre separation of 600 mm, while the three trusses nearest the front side of the building and the two trusses nearest the rear side of the building have a separation of 300 mm.

Figure 3:
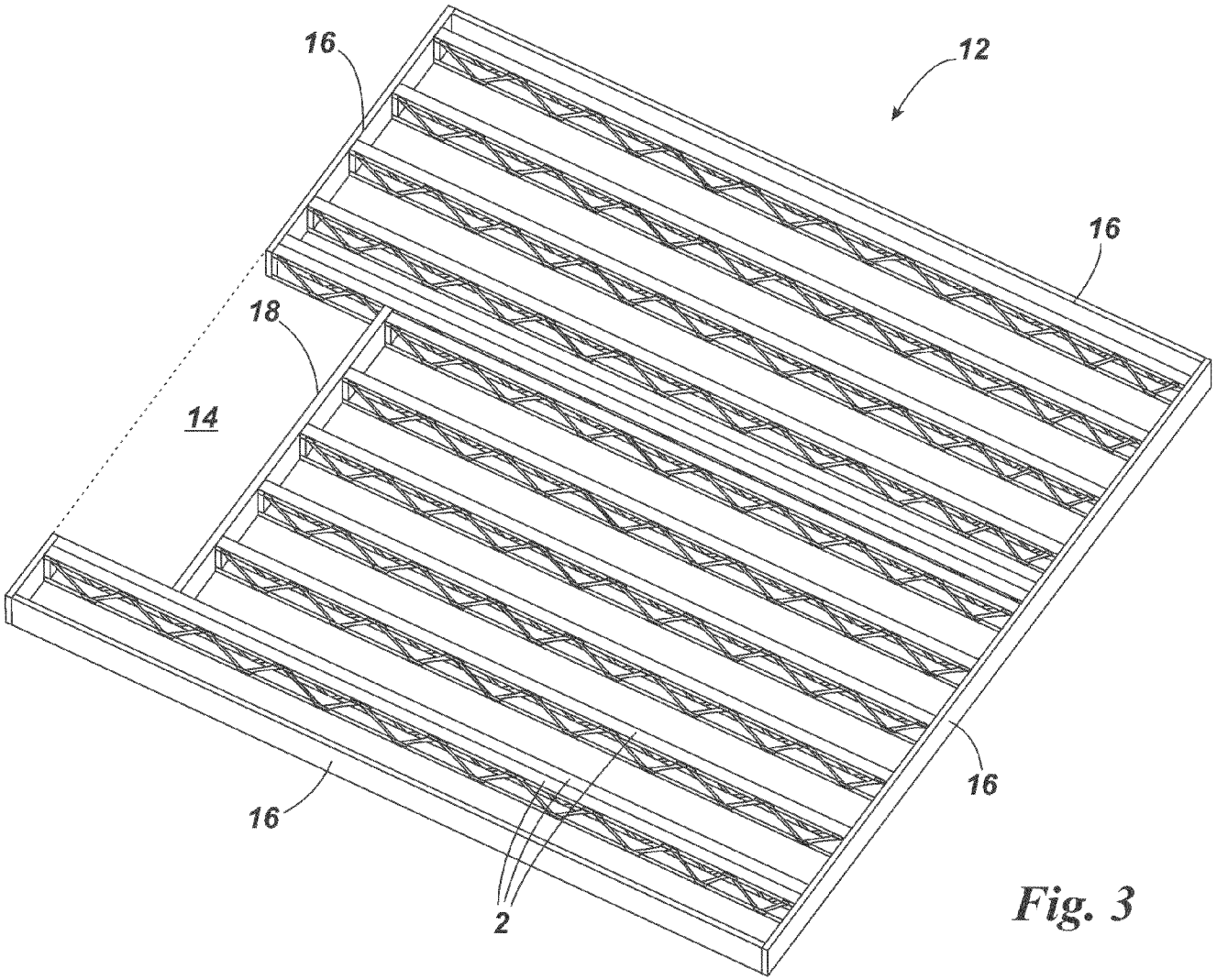
FIG. 3 is a perspective view showing the layout of the trusses forming the upper floor of the house.

The framework of the upper floor 12 is constructed from eight trusses of type T9 and five trusses of type T10, each having upper and lower joists of equal length. As illustrated in FIG. 3, these trusses 2 are arranged parallel to one another, at specified separations. The shorter T10 type trusses provide an opening 14 for a staircase. The framework is completed by a ring beam 16 that extends around the periphery of the framework and a trimmer element 18 that extends across the ends of the shorter T10 type trusses adjacent the staircase opening 14.

Figure 4:
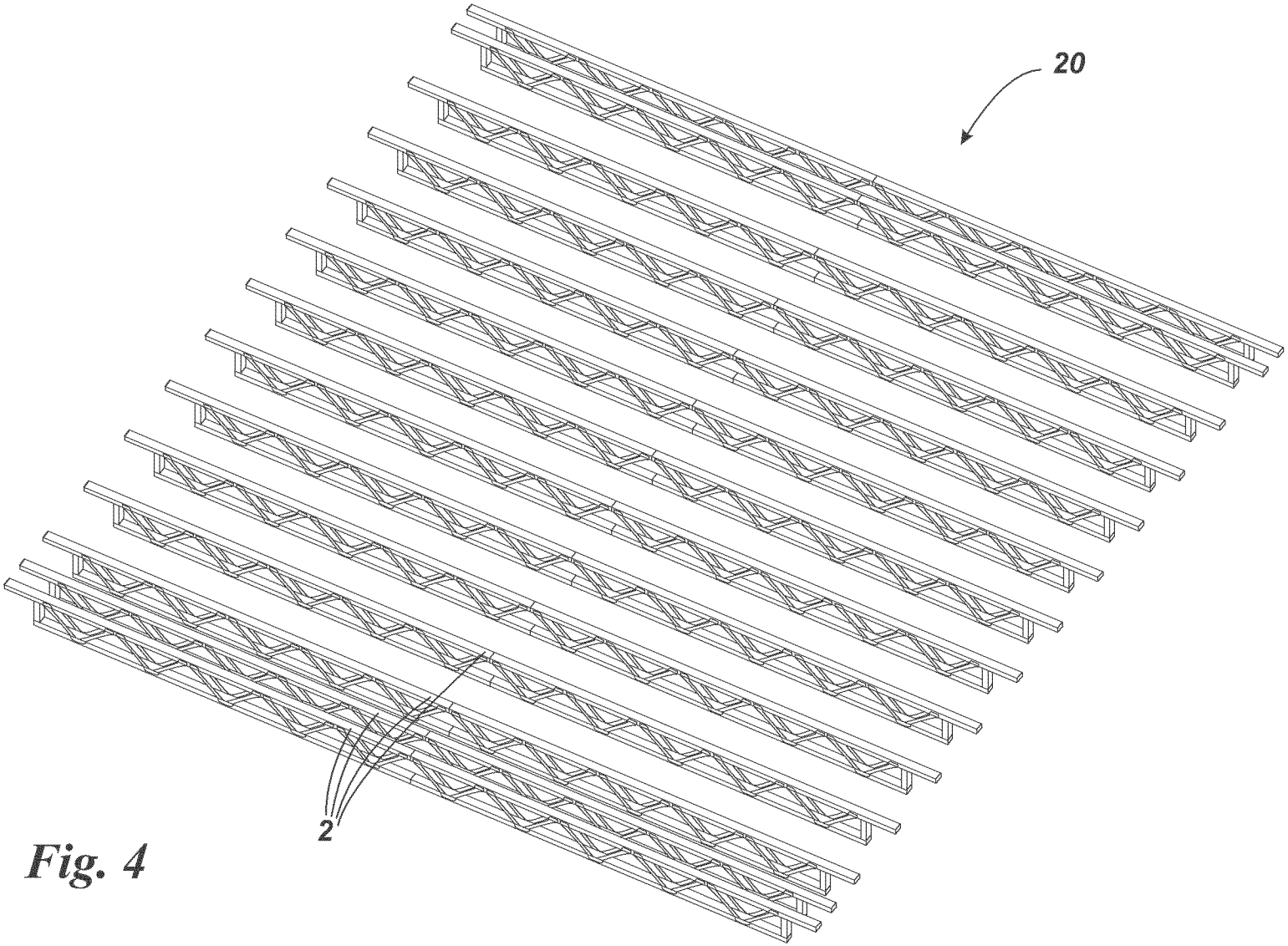
FIG. 4 is a perspective view showing the layout of the trusses forming the ceiling of the house.

The framework of the ceiling structure 20 is constructed from fourteen trusses of type T8, each having a longer upper joist and a shorter lower joist. As illustrated in FIG. 4, these trusses 2 are arranged parallel to one another, mostly at a separation (centre to centre) of 600 mm, while the three trusses nearest the front side of the building and the two trusses nearest the rear side of the building have a separation of 300 mm.

Figure 5:
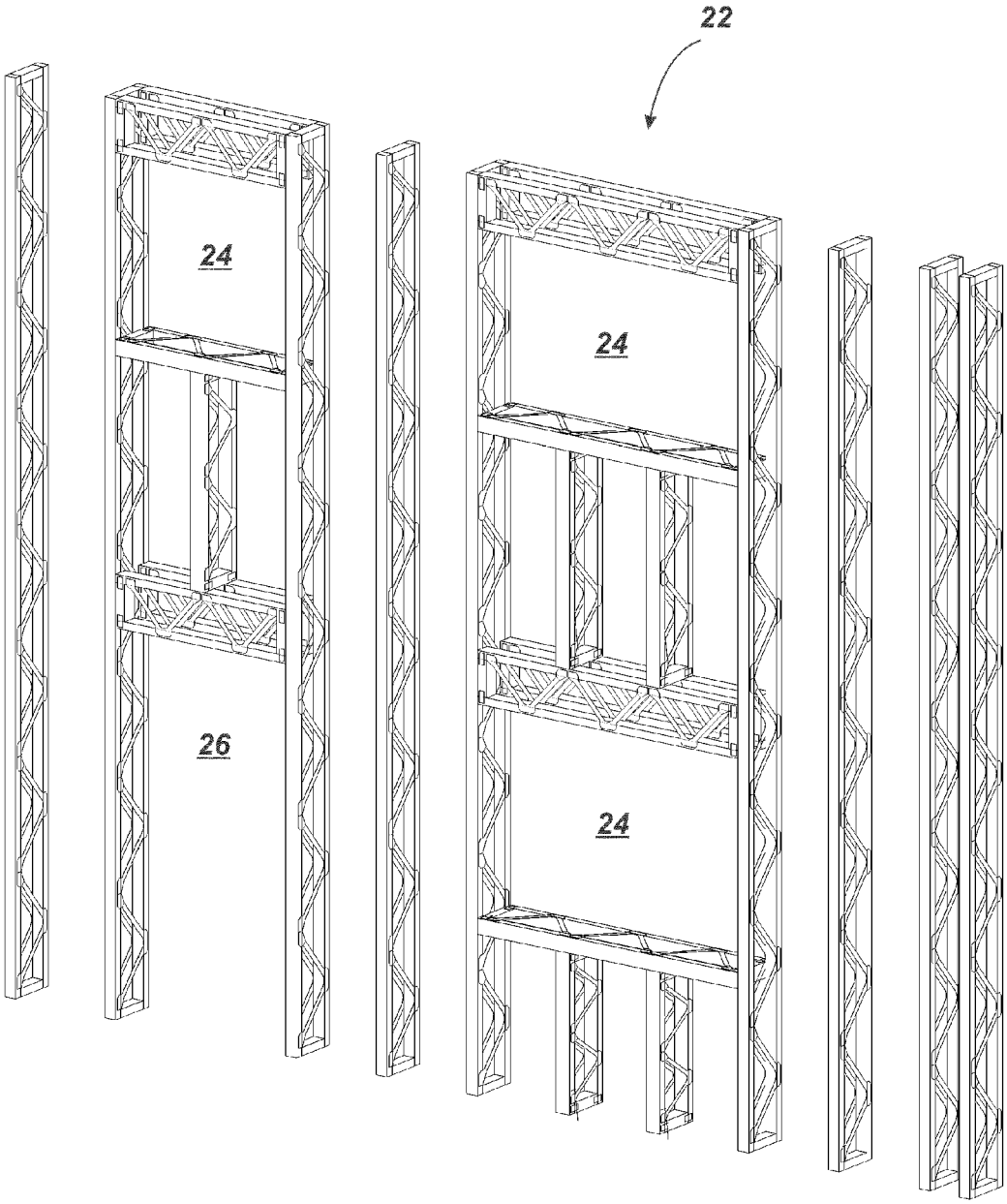
FIG. 5 is a perspective view showing the layout of the trusses forming the front wall of the house.
Figure 6:
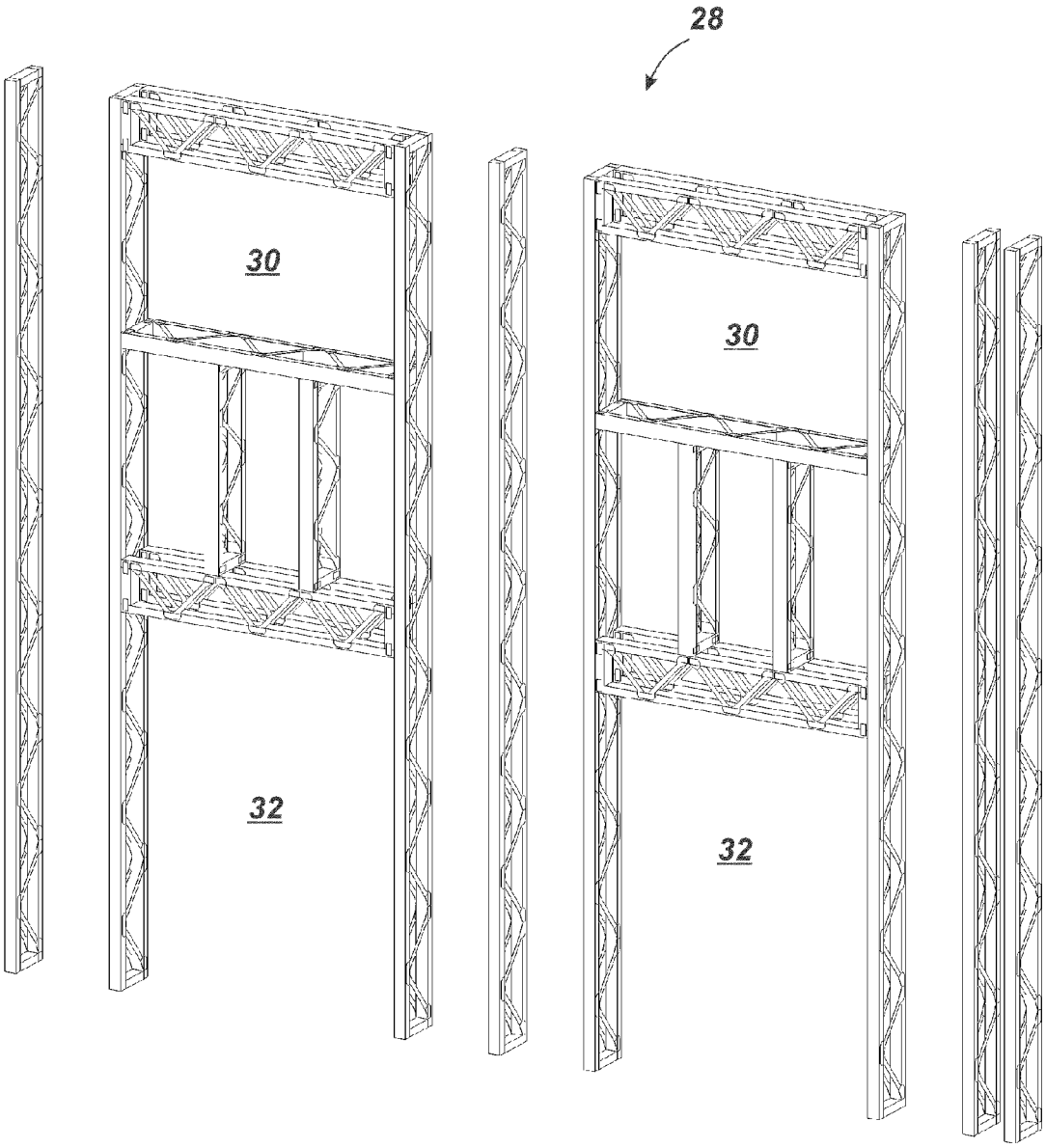
FIG. 6 is a perspective view showing the layout of the trusses forming the rear wall of the house.

The framework of the front wall 22 is constructed from trusses of types T1, T2, T3, T4 and T6, as shown in FIG. 5. Nine trusses of type T6 as arranged vertically to form the main structure of the wall, while the other trusses are set either vertically or horizontally to create three window openings 24 and a door opening 26. The framework of the rear wall 28 shown in FIG. 5 has a rather similar structure, comprising trusses of types T3, T4 and T6, which are arranged to provide openings for two upper windows 30 and two lower windows or doors 32.

Figure 7:
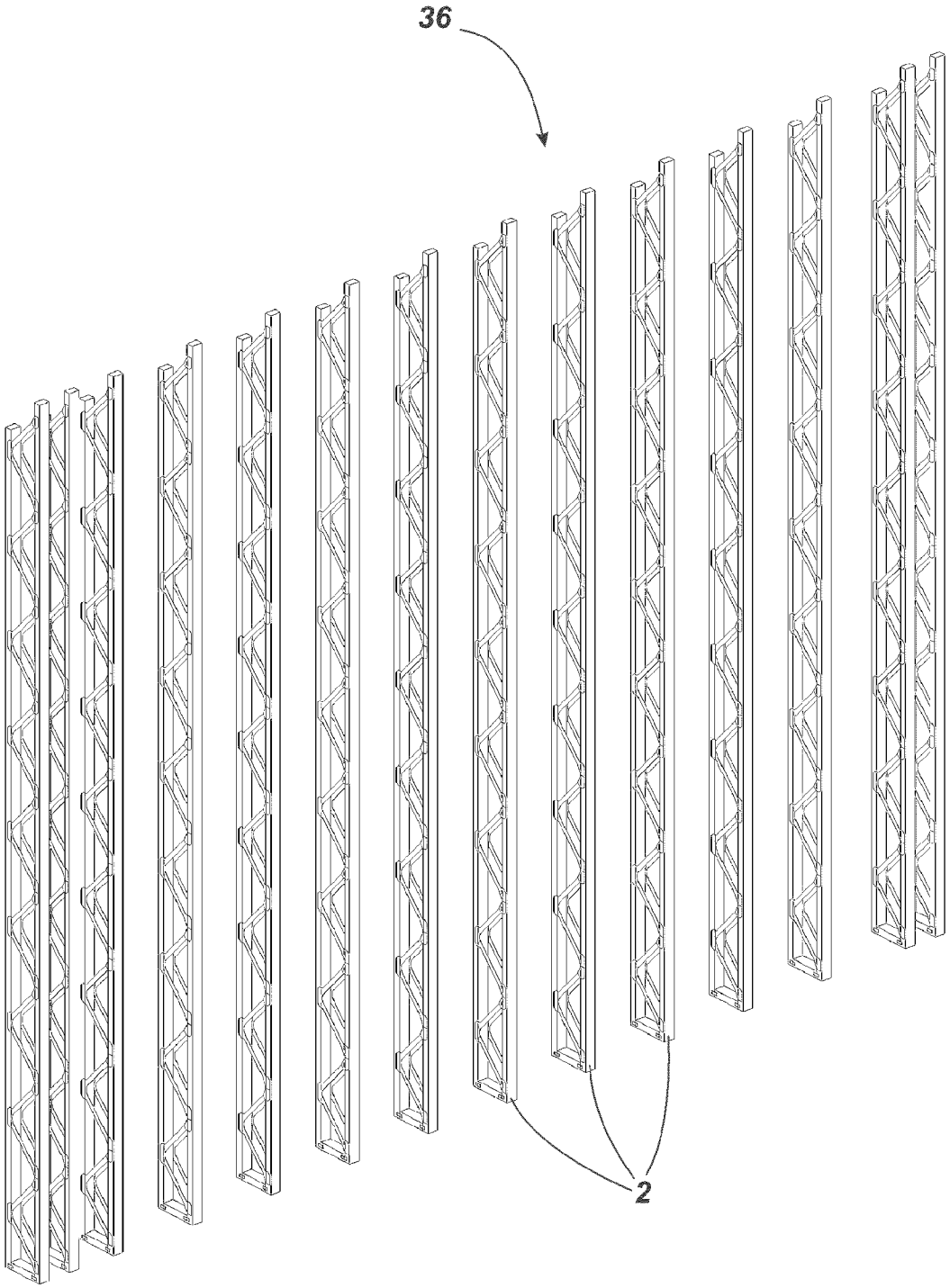
FIG. 7 is a perspective view showing the layout of the trusses forming the right hand wall of the house.
Figure 8:
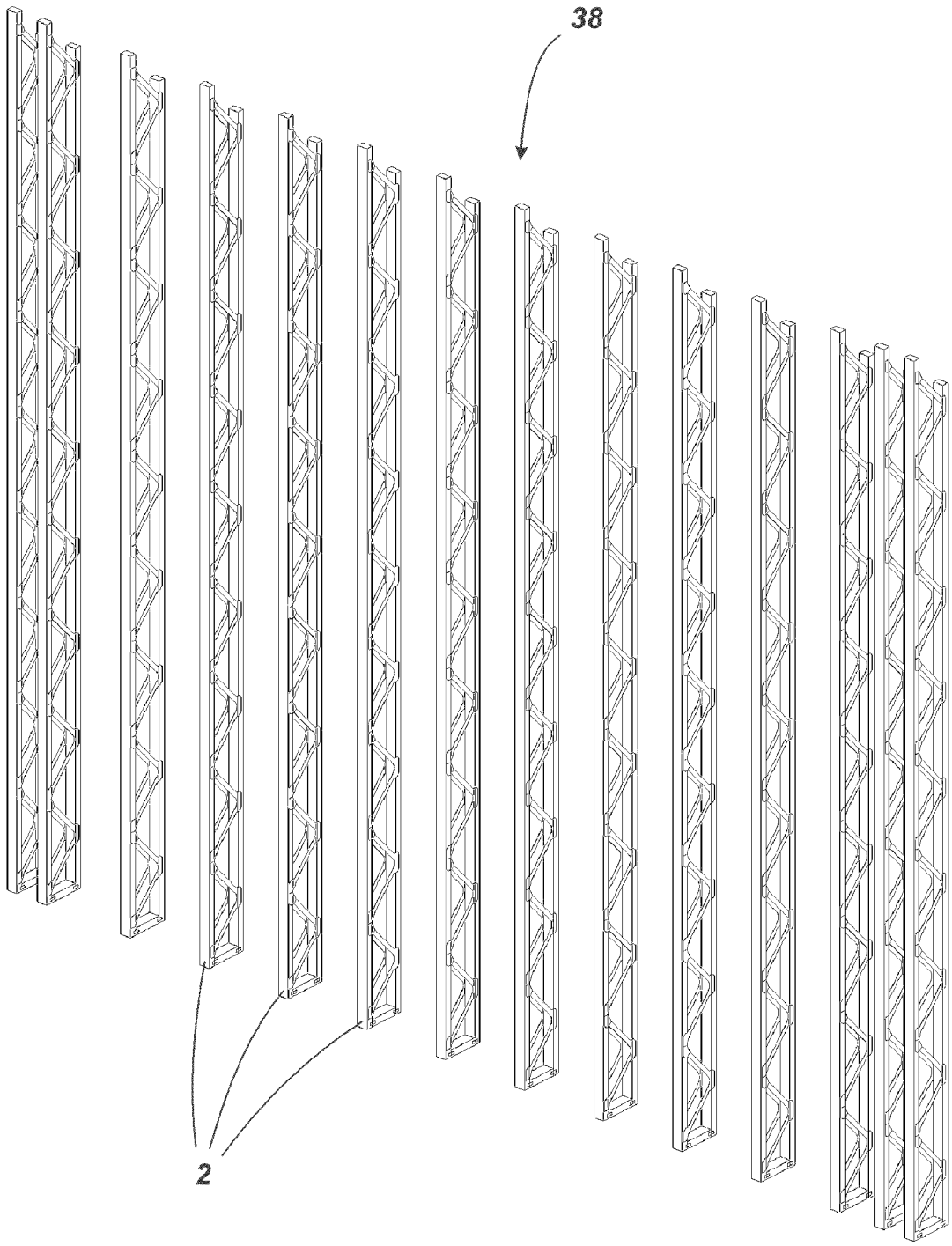
FIG. 8 is a perspective view showing the layout of the trusses forming the left hand wall of the house.

The right and left side walls 36,38 shown in FIGS. 7 and 8 each consist of fourteen trusses of type T5, each truss having at its upper end a shorter inner joist and a longer outer joist. These trusses 2 are arranged vertically, mostly at a separation (centre to centre) of 600 mm, while the three trusses nearest the front side of the building and the two trusses nearest the rear side of the building have a separation of 300 mm, so as to match the separation of the trusses forming the ground floor and the ceiling.

Figure 9:
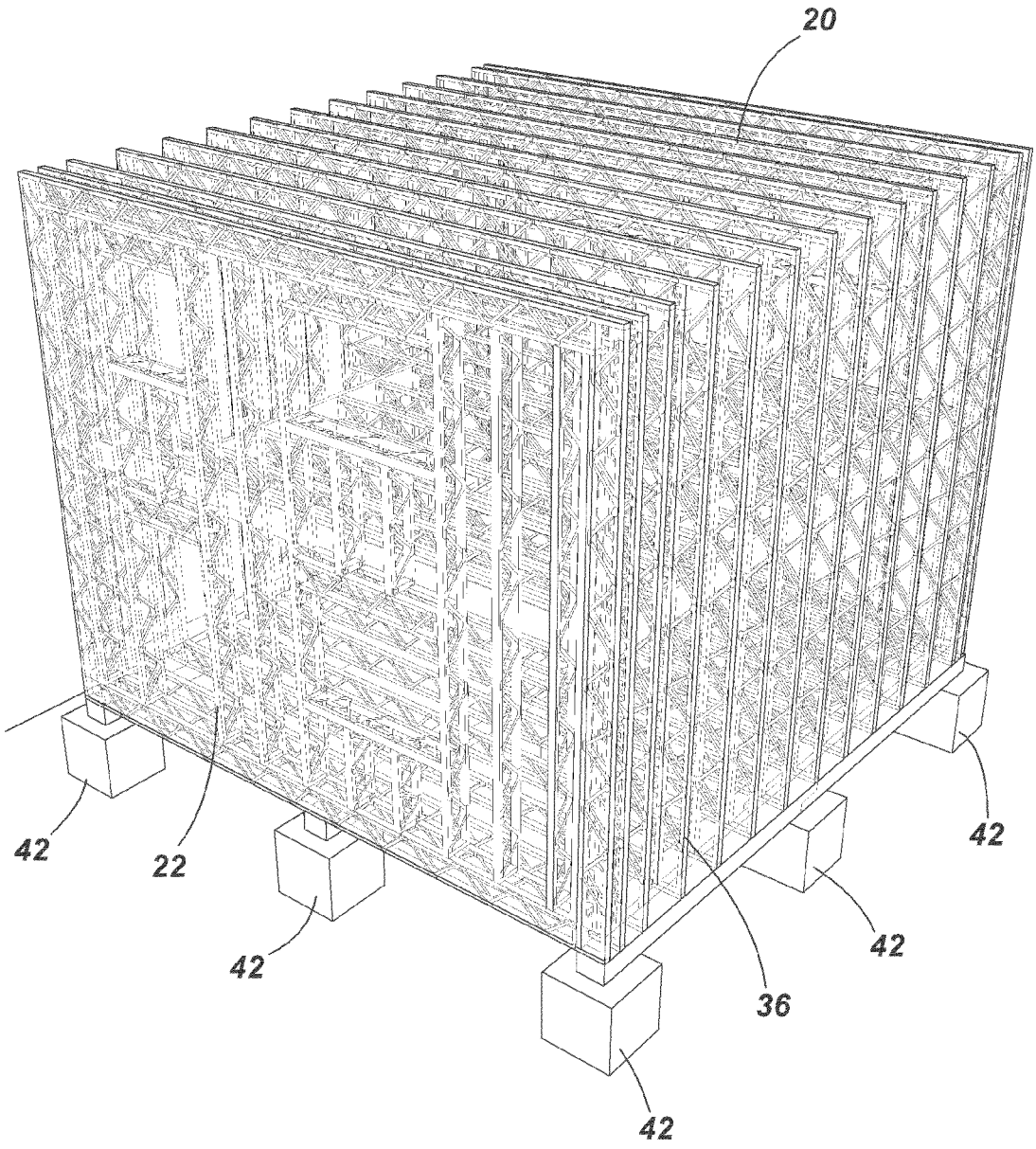
FIG. 9 is a perspective view showing the completed framework of the house.
Figure 10:
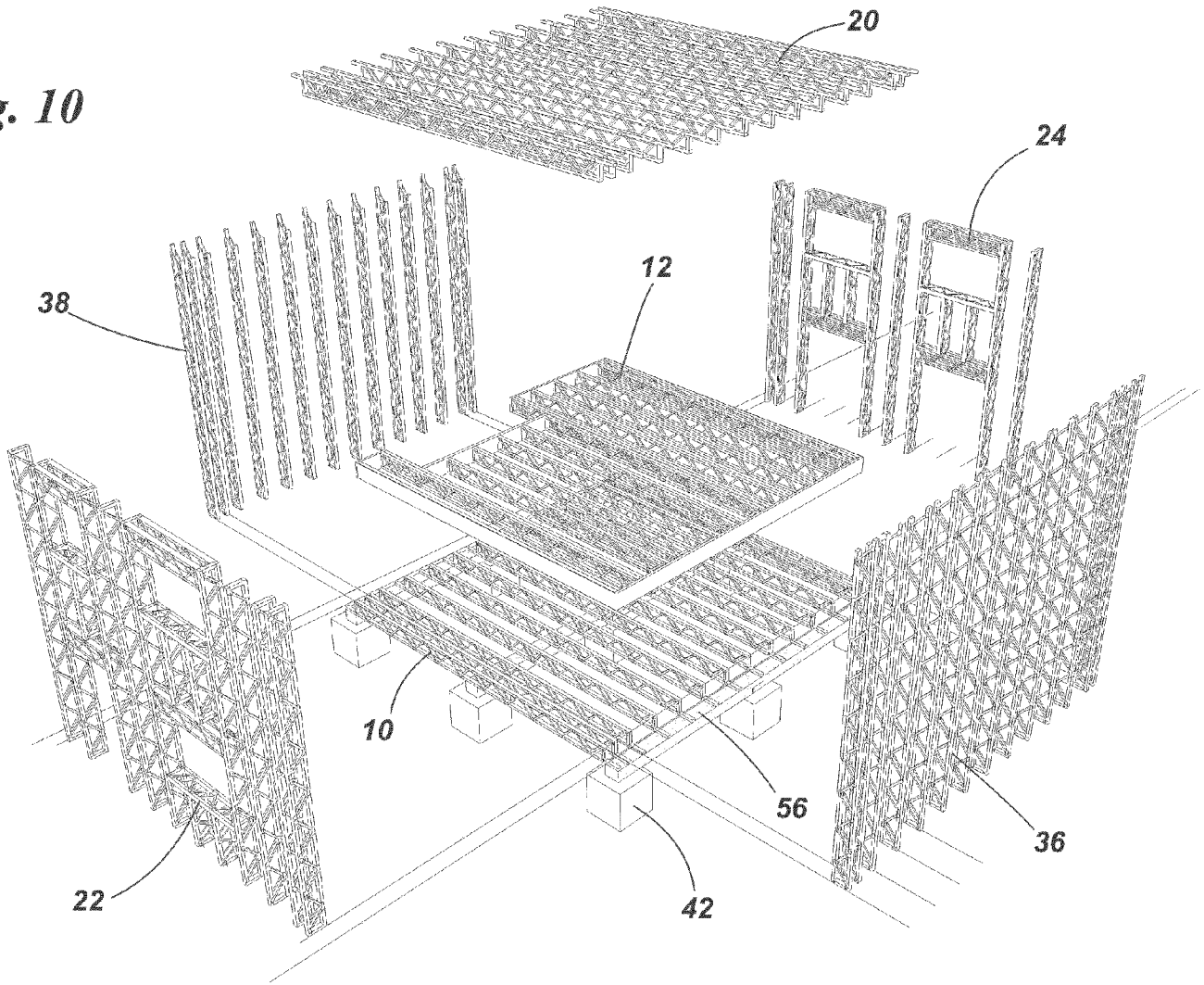
FIG. 10 is an exploded perspective view showing the completed framework of the house.

FIGS. 9 and 10 show the completed framework of the building comprising the ground floor 10, the upper floor 12 and the ceiling structure 20 as well as the front wall 22, the rear wall 28 and side walls 36,38. The trusses forming the ground floor 10, the opposed side walls 36,38 and the ceiling structure 20 are joined end to end to form fourteen rectangular frame structures that each extend continuously around the building. The frameworks of the front and rear walls 22, 28 are supported by the trusses of the floor structure and are connected directly to the frameworks of the ground floor 10, the ceiling structure 20 and the side walls 36, 38. This gives the completed framework of the building great strength and rigidity.

It will be noted that the outer joists of the opposed side walls 36, 38 are connected to the outer joists of the ground floor 10 and the ceiling structure 20 (that is, the lower joists of the floor and the upper joists of the ceiling structure), while the inner joists of the side walls are connected to the inner joists of the ground floor and the ceiling structure. The ends of the joists are connected for example using metal wall plates and screws. The inner and outer joists of the front and rear walls 22, 28 are similarly connected respectively to the inner and outer joists of the ground floor 10 and the ceiling structure 20.

Once the inner and outer surfaces of the framework have been covered with boards, this construction provides a void 40 that extends continuously around all four external walls 22,28,36,38, the ground floor 10 and the ceiling structure 20. Subsequently, this void 40 is filled with a thermal insulating material to provide an insulating layer that extends continuously and seamlessly around all external sides of the building.

The upper floor structure 12 also includes a void between the upper and lower joists, but in this embodiment the upper floor void is separated from the void in the surrounding walls by the ring beam 16, which is attached to the inner joists of the walls. Therefore, when the insulating material is injected into the walls, it does not flow into the upper floor void: it is not needed in this location as the upper floor 12 does not form an external surface of the building. However, if it is desired to provide an insulating layer within the upper floor structure, for example to reduce the flow of heat within the building, this can be achieved by providing a number of holes in the ring beam 16 so that the insulating material can flow into the upper floor void.

Figure 11:
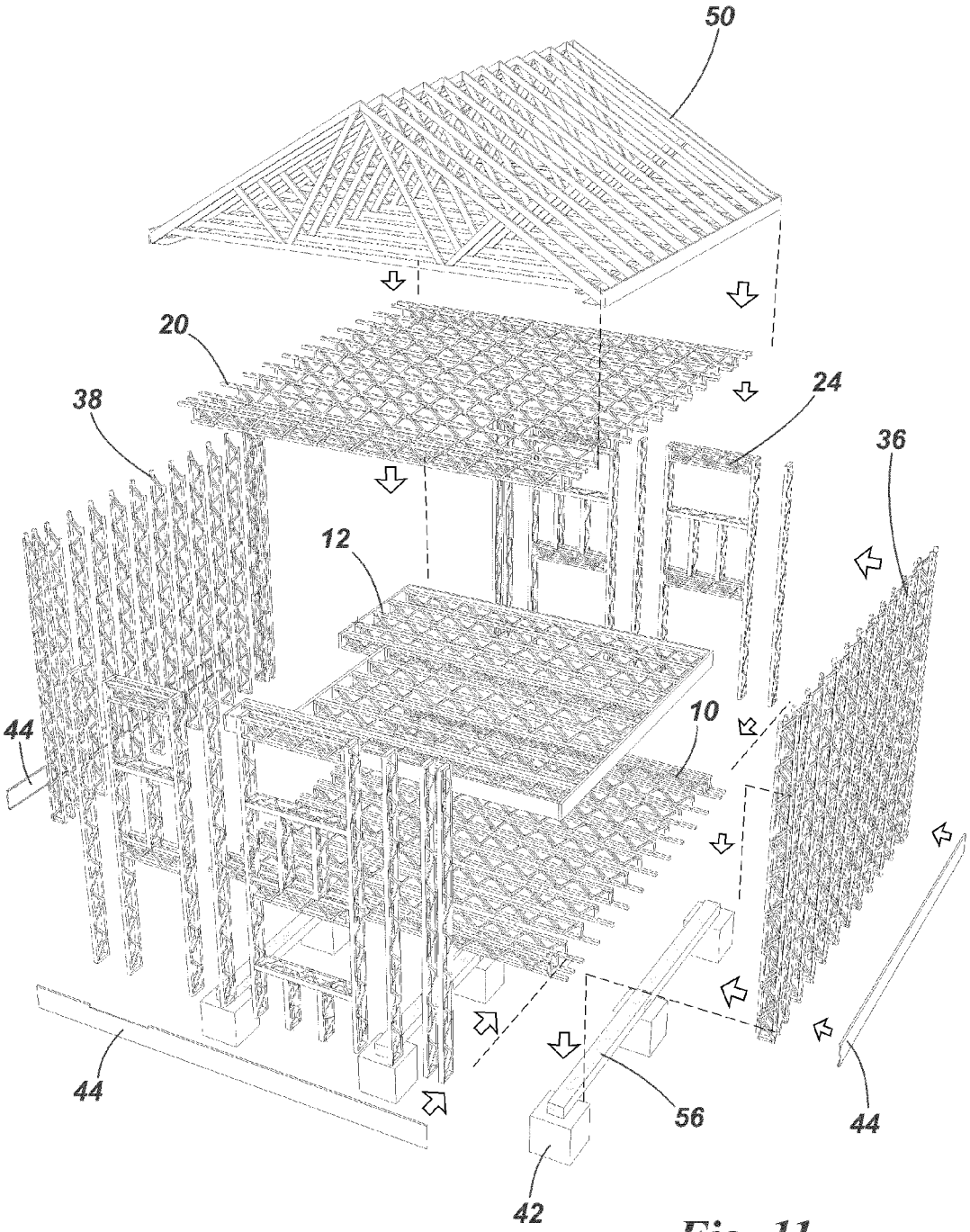
FIG. 11 is an exploded perspective view showing the structural skeleton of the house, including the roof structure.
Figure 12:
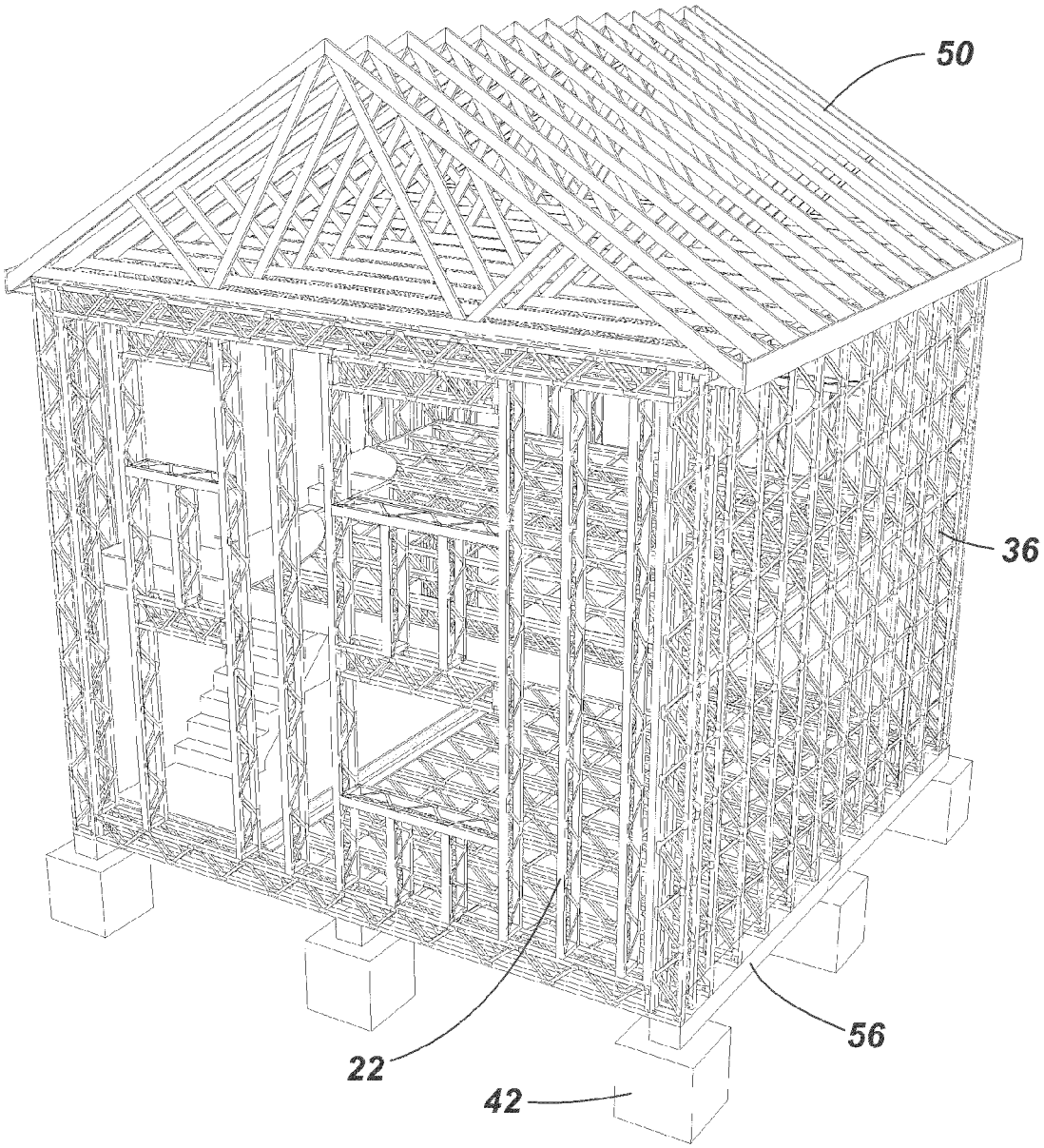
FIG. 12 is a perspective view showing the completed structural skeleton of the house.

FIGS. 11 and 12 show the completed structural skeleton of the building including, in addition to the framework of FIGS. 9 and 10, the foundations 42, a damp proof course (DPC) 44, a staircase 46 and the roof structure 50. In this case, the roof structure 50 is formed from a set of conventional roof trusses 52, to provide a loft space between the ceiling structure and the pitched roof. Numerous other roof structures may also be used, including pitched, flat and inclined roof structures.

Figure 19:
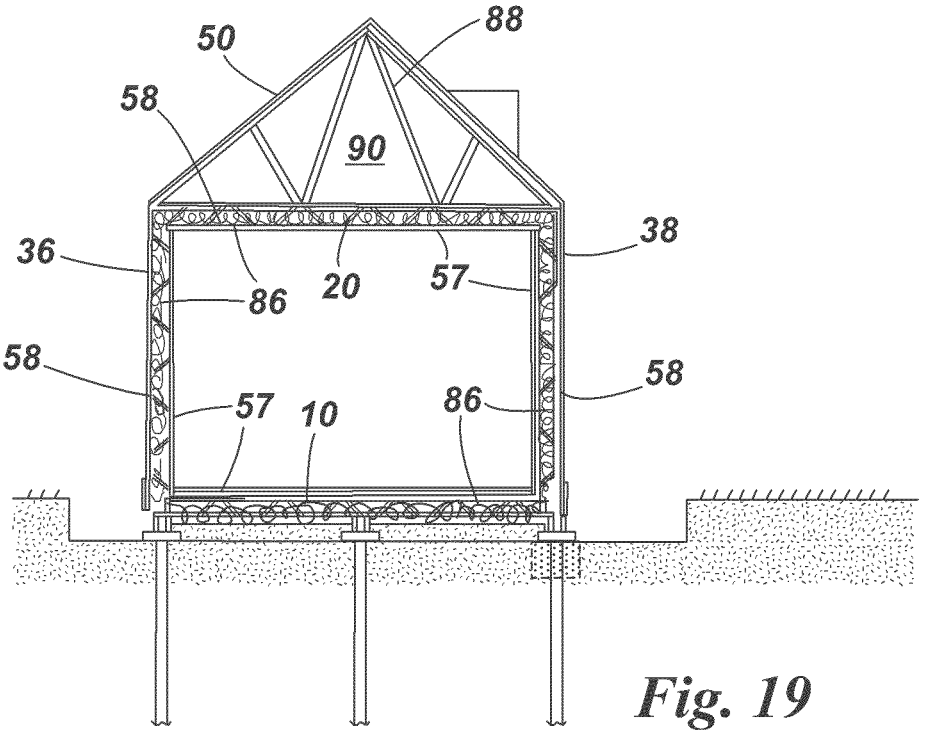
FIGS. 19 and 20 are cross-sectional views through two completed houses having alternative arrangements for insulating the roof structure.

Alternatively, as shown in FIG. 19 a pitched roof structure may be formed using trusses of the type used in construction of the walls and floors, and this roof structure may be attached to the walls in a similar manner to the ceiling structure described previously, so that void in the roof structure is connected continuously to the void in the walls. Then, when insulating material is injected, it will form an insulating layer that extends continuously around all external sides of the building, including the roof structure. In this case, a conventional ceiling structure may be provided, if required. The insulating layer will be located above the ceiling structure and the loft space.

Figure 14:
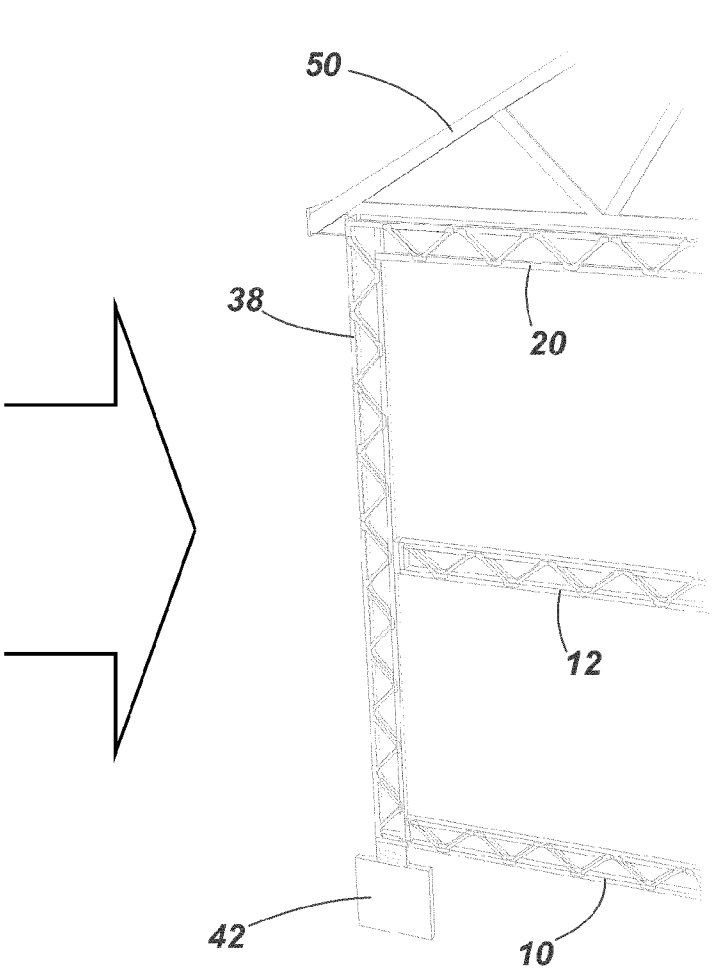
FIGS. 13 and 14 are perspective views illustrating a method of joining the trusses.
Figure 13:
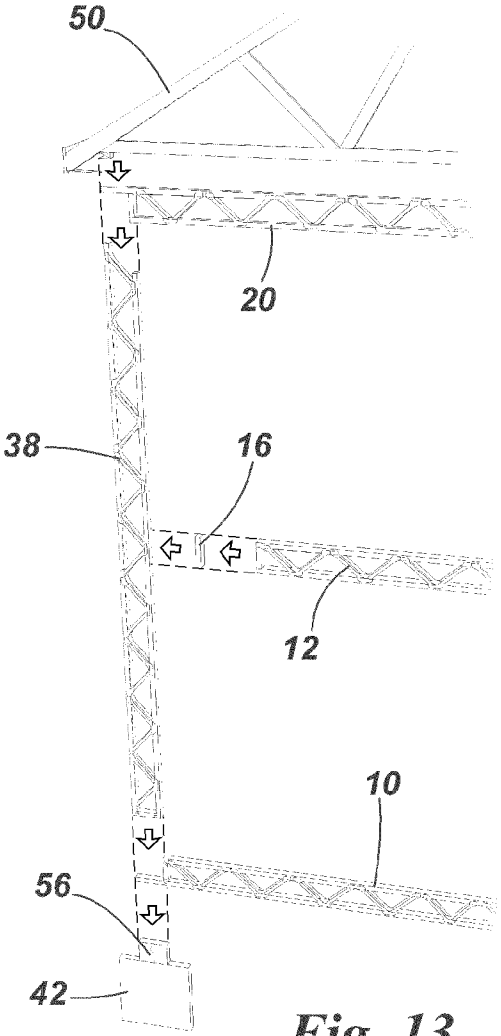

Further details of the building structure are illustrated in FIGS. 13 to 17. FIGS. 13 and 14 show details of the jointing method for joining together the ends of the trusses 2 forming the ground floor 10, a side wall 38 and the ceiling structure 20, as well as the upper floor structure 12. The outer joists of the floor and ceiling trusses and the outer joist at the upper end of each wall truss are extended so that they interconnect with one another. The inner joists are similarly interconnected. The joists are fixed to one another for example with wall plates and screws. The floor joists are fixed to the foundations 42, for example using fixing bolts (not shown). The joists of the upper floor structure 12 are connected to the ring beam 16, which is attached to the inner joists of the wall trusses. The roof trusses 52 are attached to the trusses of the ceiling structure 20 using wall plates.

Figure 15:
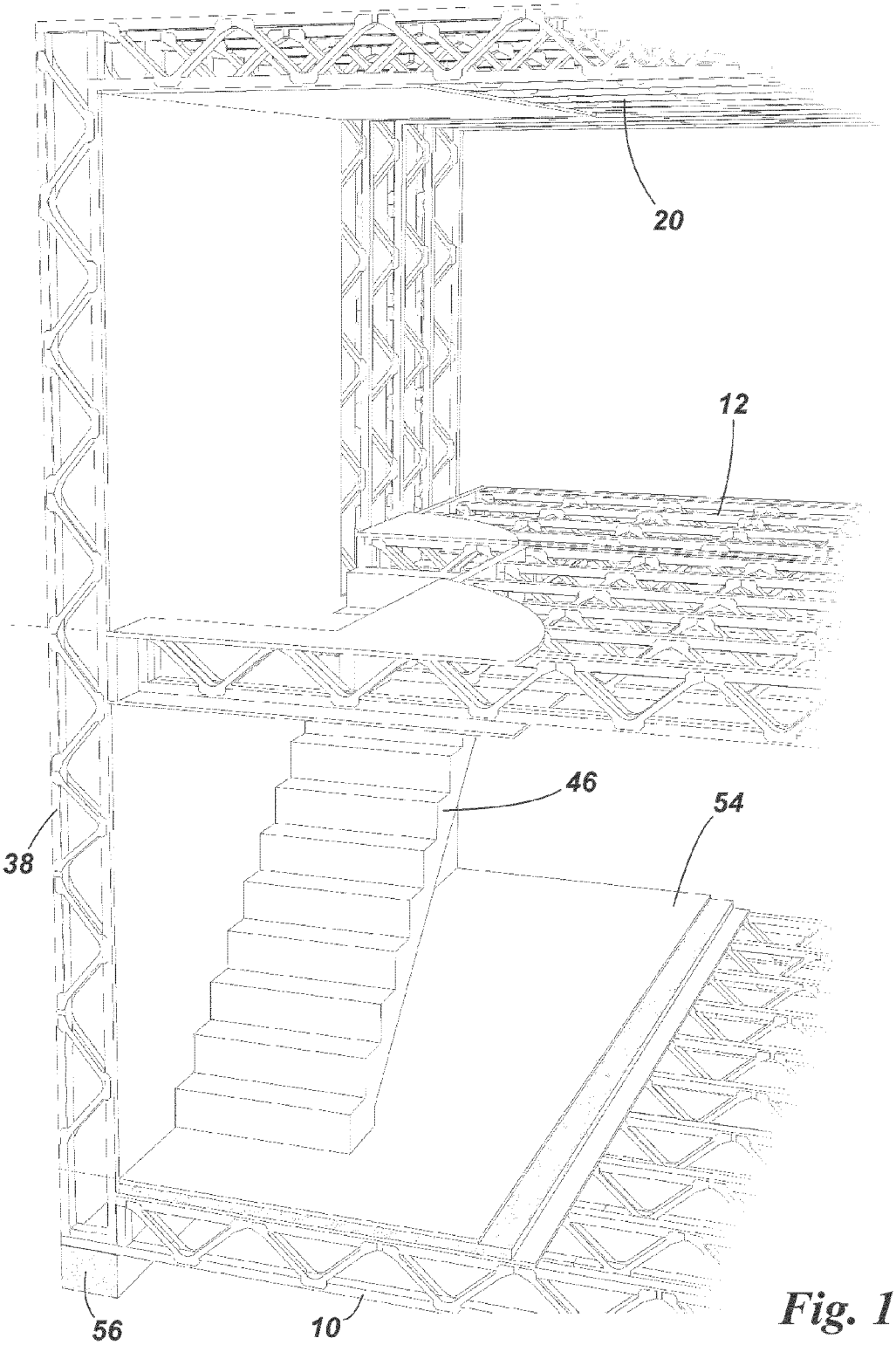
FIG. 15 is a perspective view showing a detail of the completed structural skeleton.

FIG. 15 shows details of the internal panelling applied to the framework. The framework of the ground floor 10 is covered with flooring panels 54 comprising a layer of 18 mm oriented strand board (OSB), a layer of 50 mm expanded polystyrene (EPS) insulation board and to finish a 22 mm OSB deck. The inner surfaces of the walls 38 are covered with 18 mm OSB. The framework of the upper floor 12 is covered with a 22 mm OSB deck. The ceilings are covered with 18 mm OSB.

Details of the foundations are shown in FIG. 16. The building is supported on concrete ground beams 56, which are fixed with bolts 55 to buried concrete pads 42. This is generally adequate, as the building has a very light weight. If a larger, heavier building is being constructed, more extensive foundations or piles may be required.

Details of the completed building structure are shown in section in FIG. 17. The framework made up from the trusses 2, including the floor structure 10, the walls 22, 28, 36, 38 and the roof structure 50, is entirely covered with an inner covering layer 57 and an outer covering layer 58 to form a void 40 that extends around the external surfaces of the building. Boarding of various kinds is used to form the inner and outer covering layers, except in the case of the floor structure where the outer covering layer is formed by a damp proof membrane (DPM) 62 laid beneath the floor.

The ground below the floor trusses 10 is covered with a 75 mm layer of sand/cement screed 58 over a 100 mm layer of compacted hardcore 60. The damp proof membrane 62 is laid over the screed layer and extends outwards between the side walls 38 and the ground beams 56. The edge of the DPM 62 is taken upwards to cover the lower part of the wall structure 38, typically to a height of about 500 mm. The outer surface of the wall structure is covered with an 18 mm layer of OSB 64 (the lower part of which is covered by the DPM), followed by a 60 mm layer of EPS insulating board 66, and is finished with a layer of a chosen rendered cladding 68. The lowest part of the wall is protected by a moulded plastic damp proof course 70, which is fitted over a batten 72 that fixes the DPM over the vertical OSB board. The inner surface of the wall structure is covered with an 18 mm layer of OSB 73.

Figure 18A:
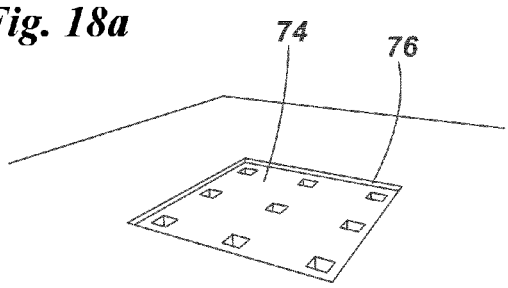
FIGS. 18*a*-18*t* illustrate a series of consecutive steps in a method of constructing the house.
Figure 18B:
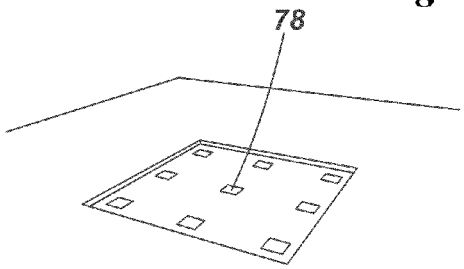
Figure 18C:
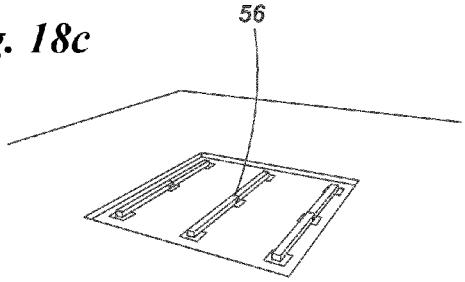
Figure 18D:
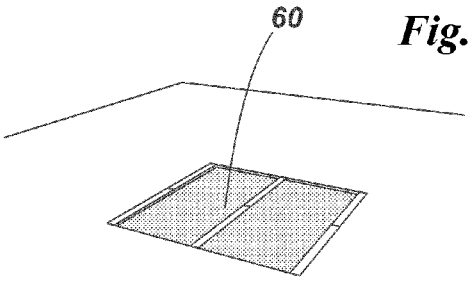
Figure 18E:
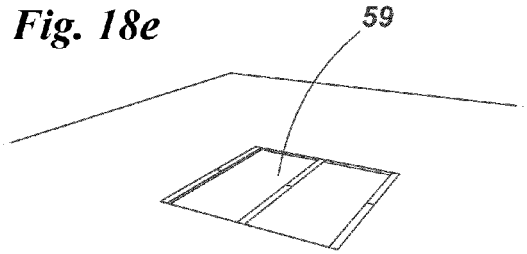
Figure 18F:
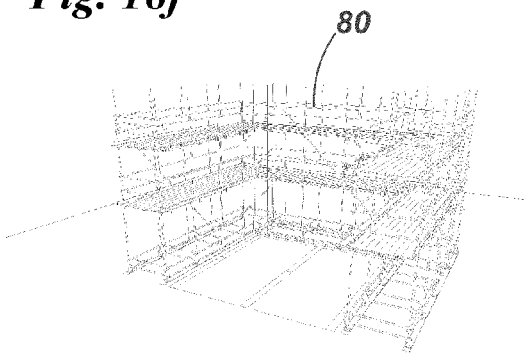
Figure 18G:
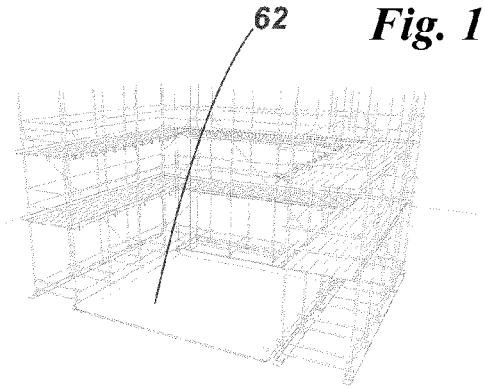
Figure 18H:
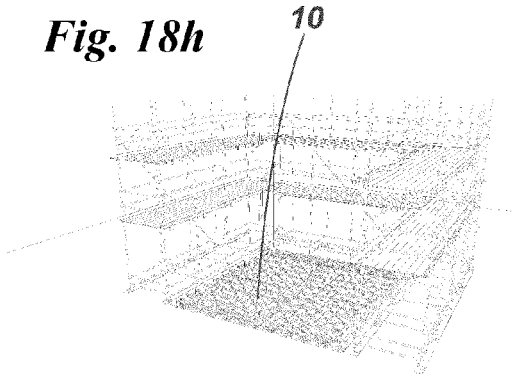
Figure 18I:
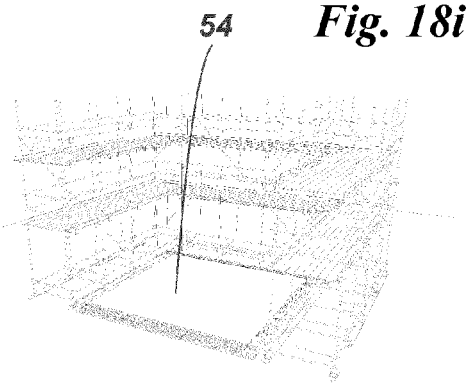
Figure 18I:
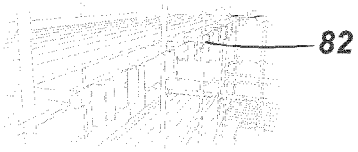
Figure 18J:
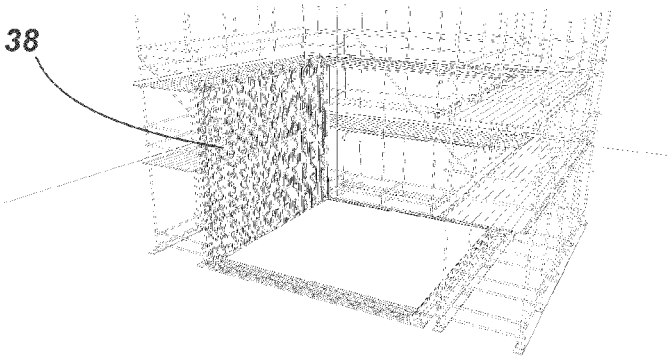
Figure 18K:
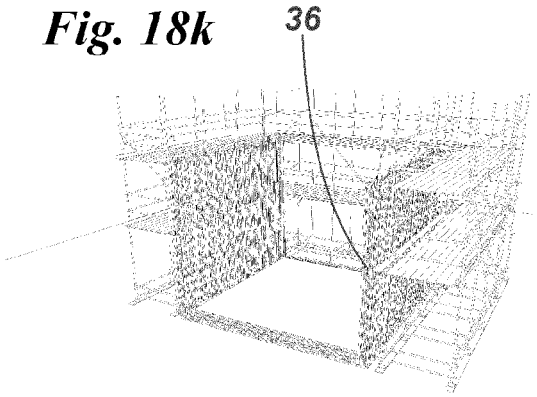
Figure 18L:
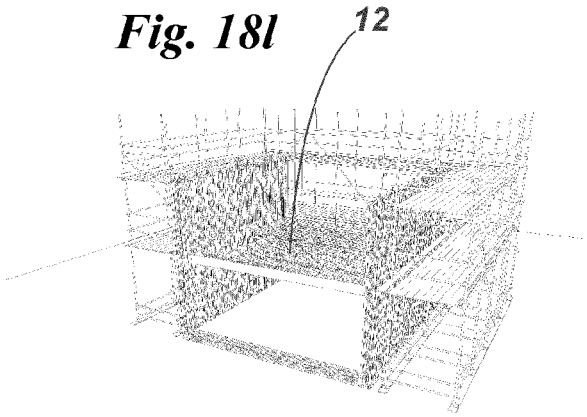
Figure 18M:
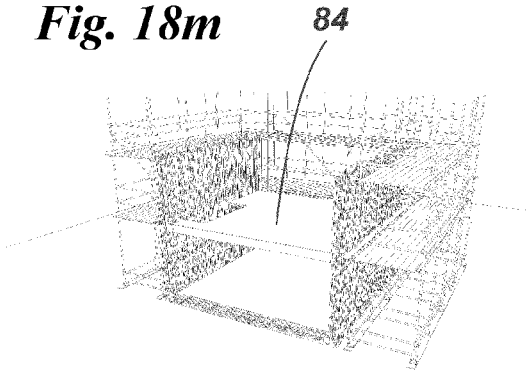
Figure 18N:
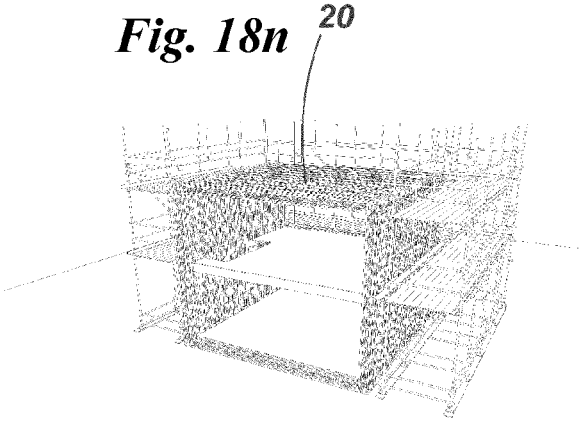
Figure 18O:
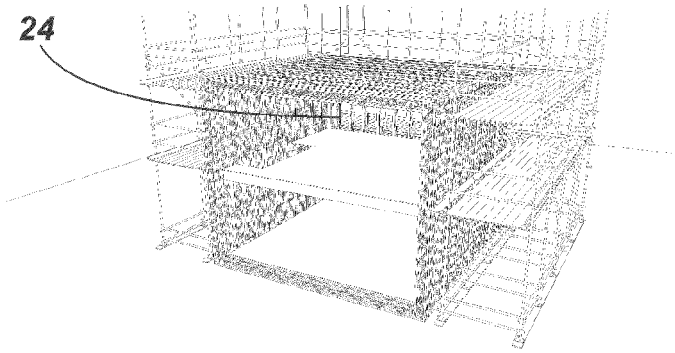
Figure 18P:
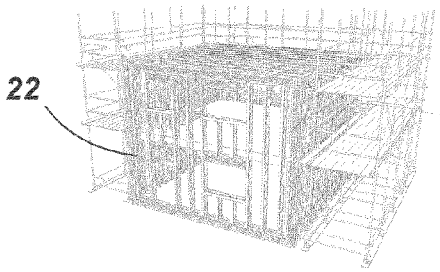
Figure 18Q:
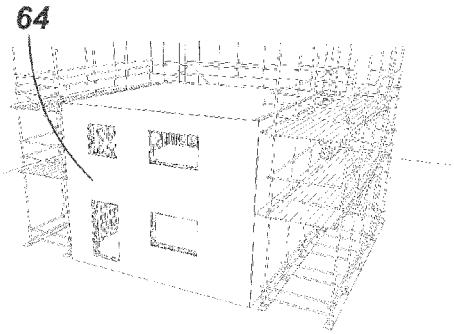
Figure 18R:
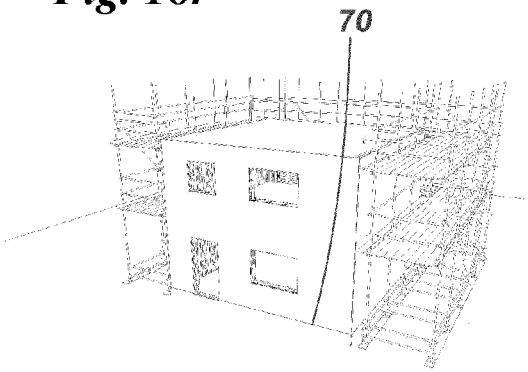
Figure 18S:
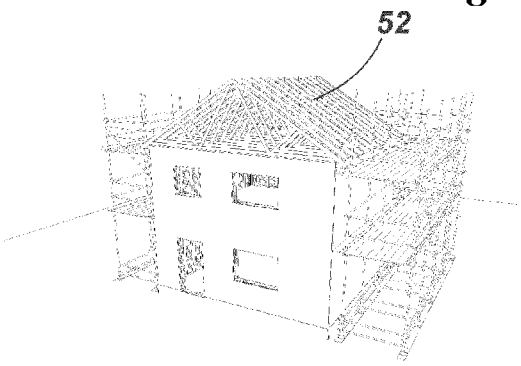
Figure 18T:
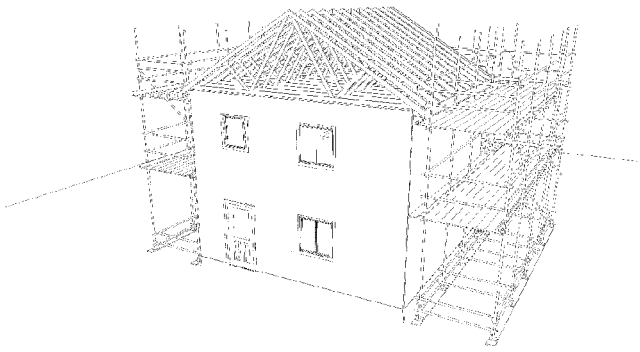

A method of constructing a building is illustrated schematically in FIGS. 18*a*-18*t*. Step 1 corresponds to FIG. 18*a*, step 2 corresponds to FIG. 18*b* and so forth, with step 20 corresponding to FIG. 18*t*. In this example the building is a house. It should be understood however that the method may also be applied to the construction of other buildings.

Step 1 illustrates an early stage of construction. The top soil has been removed from the building site, leaving a shallow excavation 74 covering the floor area of the building. A series of foundation holes 76 have been excavated. In step 2, concrete is poured into these holes to form a set of concrete foundation pads 78. These two steps of the construction method are conventional and so will not be described further.

Concrete ground beams 56 are then laid across the foundation pads 78 to form the base structure of the building (step 3). The area between the beams is then filled with hardcore 60 and covered with concrete/sand screed 59 (steps 4-5). Scaffolding 80 is then erected around the building site (step 6): the scaffolding erected across the front of the building has been omitted for the sake of clarity. A damp-proof membrane (DPM) 62 is laid across the beams 56 and the screed 58 (step 7). Alternatively, if sub-floor ventilation is required, the screed may be omitted: the damp-proof membrane 62 is then simply laid across the beams 56.

In order to construct the floor 10 a predetermined number of previously assembled trusses 2 are laid across the beams 56 so that they extend at right angles to the beams across the width of the building (step 8). The trusses 2 are arranged edgewise with respect to the beams 56, so that in each truss one of the joists is located vertically above the other joist. The upper joist forms an upper part of the floor structure, while the lower joist forms a lower part of the floor structure.

Correct spacing of the trusses 2 may be ensured by use of a comb-shaped template (not shown) having a plurality of recesses for receiving the ends of the trusses. After the trusses have been secured in position, the template may be removed. Alternatively, the spacing can be set by fitting pre-cut timber spacer elements between the trusses. The trusses are arranged so that they lie parallel to one another, typically with a centre-to-centre separation of 600 mm (although the separation may for example be in the range 100-800 mm).

After laying the trusses forming the floor 10, ground floor decking 54 of 18 mm OSB is laid to provide an accessible working surface (step 9). The next step is to erect another set of trusses to form a side wall 38 of the building (step 10). Again, the trusses 2 of the walls are normally preassembled and coded ready for erection. Each wall truss 2 is connected to an end of one of the floor trusses, so ensuring correct spacing of the wall trusses. The wall trusses are arranged vertically, with one joist on the inner side of the wall and the other joist on the outer side of the wall. Correct spacing of the upper ends of the vertical trusses 2 is ensured by clipping the trusses to scaffold clips 82 previously attached to the scaffolding. This process is repeated to erect the trusses of the other side wall 36 (step 11).

Although not shown in the drawings, battens may optionally be attached temporarily to the vertical trusses to hold them in position.

After erecting the vertical trusses that form the structure of the side walls 36,38, the next stage is to attach the ring beams 16 to side walls and assemble the upper floor structure 12 by attaching horizontal trusses to the ring beams (step 12). If required, a stair trimmer may also be attached at this stage. The upper floor decking 84 of 22 mm OSB is then laid on the upper floor trusses (step 13).

The next stage is to attach more preassembled trusses to form the ceiling structure 20 (step 14). The horizontal trusses are attached to the upper ends of the vertical trusses of the opposed side walls to form the ceiling structure 20. The correct spacing of the ceiling trusses is ensured by attaching them to the previously erected side wall trusses.

The trusses forming the rear wall 24 are then inserted and attached to the trusses of the floor structure 10, the ceiling structure 20 and the side walls 36,38 (step 15). The trusses forming the front wall 22 are assembled in a similar manner (step 16).

The next step is to apply external cladding 64 to the framework (step 17). The cladding typically includes a layer of 18 mm OSB, which is attached to the outer surfaces of the framework to cover the front, rear and side walls. The OSB secures the trusses in position, so that the building is then self-supporting. The floor structure is connected to the foundations 10 above the DPC level, and is connected through the OSB outer sheathing layer into the structural walls, thus holding the building in position. The DPM 62 is dressed up and fixed to cover the lower part of the external cladding 64. The rigid external DPC 70 is then attached to all exposed elevations (step 18).

This completes the construction of the basic framework of the building. It will be appreciated that at this stage the framework is entirely open on the inside, which allows easy inspection of all elements of the structure for compliance with building regulations. Although not shown in the drawings, services (for example, electricity and water) or conduits for those services can also be attached at this stage to the framework.

Roof trusses 52 are then located and fixed in position (step 19). Internal cladding 57 is attached to the inner surfaces of the framework and external cladding 58 is attached to the outer surfaces of the framework, covering the walls and the ceilings (step 20). Any suitable materials may be used, for example plasterboard or fireboard for the walls and the roof structure, and OSB, chipboard or floorboards for the floor. Doors and windows are also inserted.

This completes the main structure of the building. It should be noted that the void 40 between the inner and outer sheaths of the framework is entirely open. This void extends substantially continuously all around the framework of the building, including the walls, the floor and the roof structure. In this context, the term "roof structure" includes the ceiling structure and the external roof, as either of these structures may provide the void that is subsequently filled with an insulating material.

The void 40 in the walls, floor and roof structures is then filled by pumping a suitable insulating material 86 under pressure into the void. Any suitable insulating material may be used including, for example, expanding foam or EPS pellets. The insulating material 86 completely fills the void and provides a substantially continuous insulating layer that extends through the walls, the floor and the roof structure of the building, and fills any gaps in the frame boarding.

Finally, internal fitting-out of the building can be completed, and the external walls and roof can be covered in insulation boarding and external finishes including, for example, render or brick, cladding, roof tiling and so on.

In the embodiment shown in FIG. 19, a pitched roof structure 50 is formed from a set of conventional roof trusses 88, to provide a loft space 90 between the ceiling structure 20 and the pitched roof. The ceiling structure 20 is made from trusses of the type shown in FIG. 1, to provide a void that is connected to the void in the walls 36, 38. When insulating material is injected, it forms an insulating layer 86 that extends continuously around all external sides of the building, including the walls 36, 38, the floor 10 and the roof structure 50. The insulating layer in the roof structure is located in the ceiling structure 20, below the loft space 90.

Figure 20:
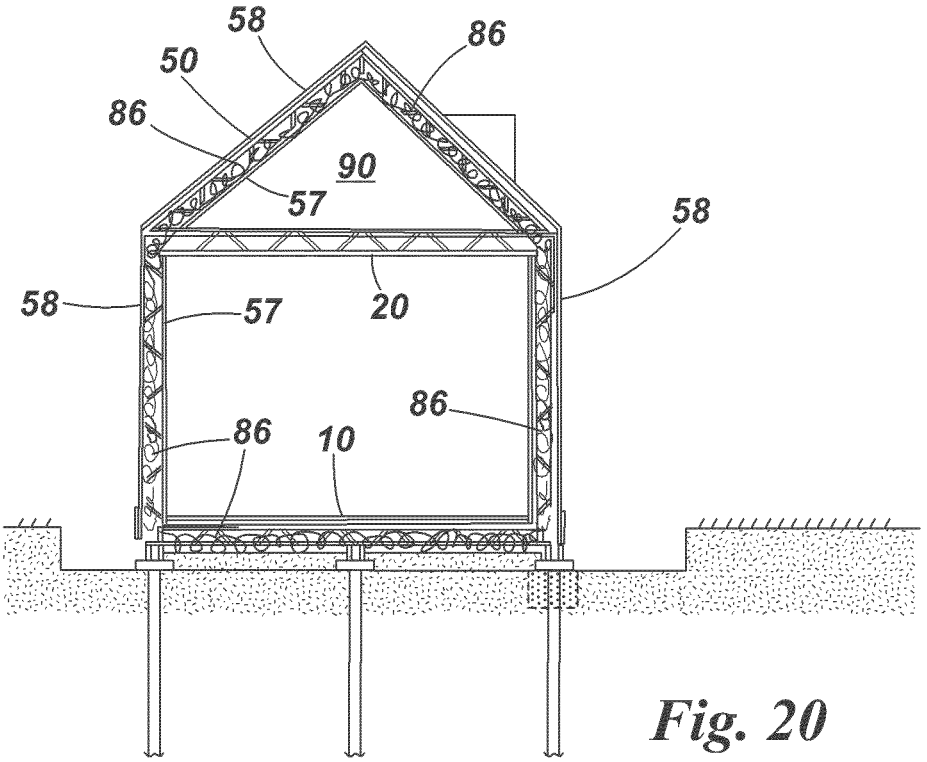

In the alternative arrangement shown in FIG. 20, a pitched roof structure 50 is formed using trusses of the type shown in FIG. 1. This roof structure 50 is attached to the walls 36, 38 such that the void in the roof structure is connected continuously to the void in the walls. When insulating material is injected, it forms an insulating layer 86 that extends continuously around all external sides of the building, including the walls 36, 38, the floor 10 the roof structure 50. In this case, the void in the ceiling structure 20 is not connected to the void in the walls, and is not filled with insulating material. The insulating layer 86 is located above both the ceiling structure 20 and the loft space 90.

Figure 21:
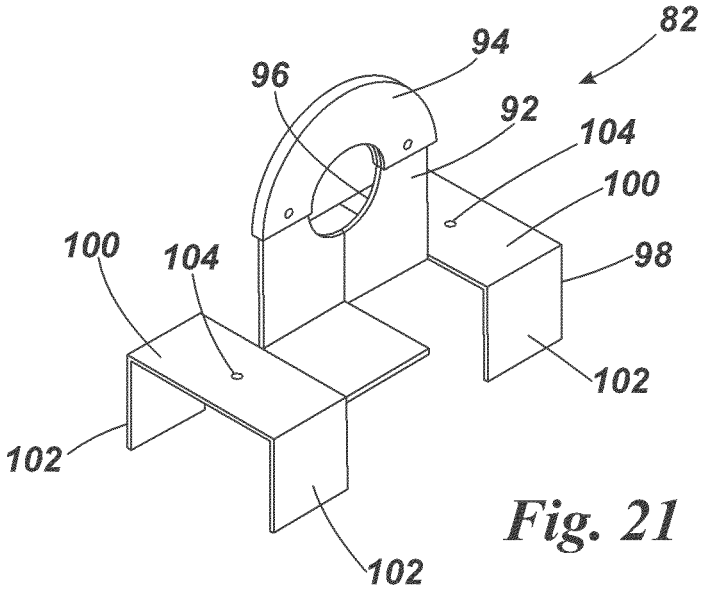
FIG. 21 is an isometric view of a scaffold clip.

The scaffold clip 82 that is used when erecting the framework of the building is shown in FIG. 21. The clip includes a plate 92 with a releasable locking element 94, which together form a circular hole 96 for receiving a horizontal scaffold pole. Connected to the plate 92 are two U-shaped supports 98, each comprising a base portion 100 and two parallel arms 102. A screw hole 104 is provided in the base portion 100.

In use, the scaffold clips 82 are attached at the appropriate spacing to a horizontal scaffold pole of the scaffolding 80 that is erected around the construction site, so that the support elements 98 are arranged one vertically above the other.

Then, as depicted in FIG. **18*j*, in step 10 the upper end of each vertical truss 2 is located between arms 102 of the support elements 98 and secured by driving screws into the truss through the screw holes 104. This ensures correct spacing of the truss and secures it in position while the rest of the framework is constructed. Once the framework has been completed, the scaffold clips 82** are removed.

Figure 22:
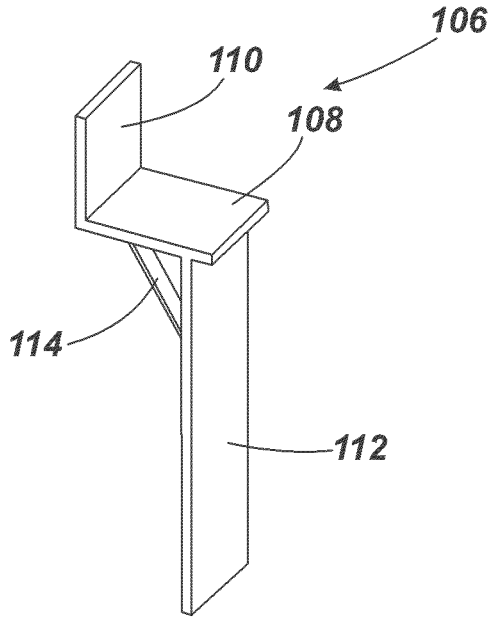
FIG. 22 is an isometric view of a panel spacer and fixing tool.

A spacing and fixing tool 106 used when attaching the external insulation and cladding boards 66, 68 depicted in FIG. 17 is shown in FIG. 22. The tool includes a horizontal base plate 108, a rear plate 110 that extends upwards from the rear edge of the base plate 108 and a front plate that extends 112 that extends downwards from underneath the base plate 108 near its front edge. A flange plate 114 extends diagonally between the base plate 108 and the front plate 112.

In use, as the external insulation and cladding boards 66, 68 are secured to the framework of the building as depicted in FIG. 17, the spacing and fixing tool 106 is used to support the boards temporarily and provides a space of about 5 mm between the edges of adjacent boards to allow for expansion and contraction of the boards. Once the boards have been secured in position, the tool 112 is removed.

The invention claimed is:

1. A method of constructing a building comprising a plurality of external walls, a roof and a floor, said method including:

erecting a plurality of truss elements to form a framework comprising at least two opposed external wall structures, a roof structure and a floor structure, each of said at least two opposed external wall structures, said roof structure and said floor structure comprising multiple truss elements, and each of said multiple truss elements including at least two joists and a plurality of braces that maintain the at least two joists in a parallel arrangement, each of said multiple truss elements being arranged in said framework to provide an inner joist and an outer joist;

attaching an inner covering layer and an outer covering layer to said framework, thereby forming a floor void within the floor structure, a roof void within the roof structure and a wall void within each of the opposed external wall structures, said floor void, roof void and wall void being interconnected to form an enclosed void between said inner covering layer and said outer covering layer that extends continuously through the floor structure, the roof structure and the at least two opposed external wall structures, said inner covering layer comprising boarding attached to said inner joist and said outer covering layer comprising boarding attached to said outer joist of said framework, and after forming the enclosed void, injecting an insulating material into said enclosed void, the insulating material flowing continuously between the floor void, roof void and wall void to at least partially fill the enclosed void and form an insulating layer between the inner covering layer and the outer covering layer that extends continuously and seamlessly through the floor structure, the roof structure and the at least two opposed external wall structures.

2. The method according to claim 1, wherein at least some of the multiple truss elements that form the floor structure, the roof structure and the at least two opposed external wall structures are interconnected end-to-end to form a continuous framework that extends through the floor structure, the roof structure and at least one of the at least two opposed external wall structures.

3. The method according to claim 2, wherein the truss elements that are interconnected end-to-end are located in a common vertical plane.

4. The method according to claim 2, wherein the at least two joists include a plurality of inner joists and a plurality of outer joists, and wherein the plurality of inner joists are interconnected, and the plurality of outer joists are interconnected.

5. The method according to claim 1, further comprising erecting a second plurality of truss elements to form at least one external end wall structure and attaching a second inner covering layer and a second outer covering layer to the external end wall structure to form an end wall void, said end wall void being connected to the enclosed void that extends through the floor structure, the roof structure and the opposed external wall structures.

6. The method according to claim 1, wherein the inner covering layer and outer covering layer forming the enclosed void have a separation in the range 50-600 mm.

7. The method according to claim 1, wherein the framework is supported on discrete piles or foundation pads.

8. The method according to claim 1, wherein a damp-proof membrane is fitted beneath the floor structure.

9. The method according to claim 8, wherein the damp-proof membrane extends at least partly up the opposed external wall structures of the building.

10. The method according to claim 1, wherein the insulating layer in the roof structure is provided within a ceiling structure or within a sloping roof structure.

11. The method according to claim 1, further comprising applying an external finishing layer to the outer covering layer of at least one of the opposed external wall structures.

12. The method according to claim 1, further comprising applying an external finishing layer to the outer covering layer of the roof structure.

* * * * *